US006186455B1

(12) United States Patent
Hollingsworth et al.

(10) Patent No.: US 6,186,455 B1
(45) **Date of Patent: *Feb. 13, 2001**

(54) FASTENER FOR HOLDING ITEMS TO A PERFORATED WALL

(76) Inventors: Don A. Hollingsworth, 10511 Keokuk Ave., Chatsworth, CA (US) 91311; Mark A. Hollingsworth, 7624 W. 84th St., Bloomington, MN (US) 55438

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

This patent is subject to a terminal disclaimer.

(21) Appl. No.: 09/203,778

(22) Filed: Dec. 2, 1998

Related U.S. Application Data

(63) Continuation of application No. 08/683,312, filed on Jul. 18, 1996, now Pat. No. 5,855,347.

(51) Int. Cl.[7] ..... A47B 46/06

(52) U.S. Cl. ..... 248/220.31; 411/349; 411/15; 211/59.1

(58) Field of Search ..... 248/220.31, 220.41, 248/220.43, 221.11; 411/57.1, 347, 349, 15; 211/59.1; 24/607

(56) References Cited

U.S. PATENT DOCUMENTS

| | | | | |
|---|---|---|---|---|
| 3,406,431 | * | 10/1968 | Armstrong | 24/607 |
| 3,722,843 | * | 3/1973 | Enckler | 248/220.31 |
| 3,964,364 | * | 6/1976 | Poe | 411/349 |
| 4,233,881 | * | 11/1980 | Carrier | 411/60 |
| 4,506,856 | * | 3/1985 | Rich | 248/220.31 |
| 4,708,552 | * | 11/1987 | Bustos | 411/60 |
| 4,728,068 | * | 3/1988 | Rivkin | 248/220.31 |
| 5,322,446 | * | 6/1994 | Bolli | 24/607 |
| 5,409,336 | * | 4/1995 | Jericevich | 411/60 |
| 5,567,098 | * | 10/1996 | Gordon | 411/60 |

FOREIGN PATENT DOCUMENTS

| | | | | |
|---|---|---|---|---|
| 1049478 | * | 2/1979 | (CA) | 248/220.41 |
| 459994 | * | 5/1982 | (DE) | 411/60 |
| 11874430 | * | 4/1970 | (GB) | 411/60 |

* cited by examiner

*Primary Examiner*—Flemming Saether
(74) *Attorney, Agent, or Firm*—Don A. Hollingsworth

(57) ABSTRACT

A fastener for holding items to a perforated wall, including fasteners for consumer and commercial uses and in displaying collector items or goods for sale, or for supporting heavy items, or for supporting shelves, platforms, wire frames and similar items on a perforated wall, the item holder having a base member with a fastener insertable into the perforated wall. The fastener has a projection with an axis preferably, but not necessarily, perpendicular to the wall and an axially extending passageway, at least a portion of the projection being displaceable laterally of its axis. An elongated pin, plunger, or cam member is insertable into the passageway in an insertion direction and is effective to displace the projection portion laterally of the projection axis for mounting the item holder to the wall. The locking mechanism may be operated by movement of the pin, plunger, or cam member axially or radially of the fastener. No tools are needed to lock or release the item holder from the perforated wall.

7 Claims, 17 Drawing Sheets

FIG. 1
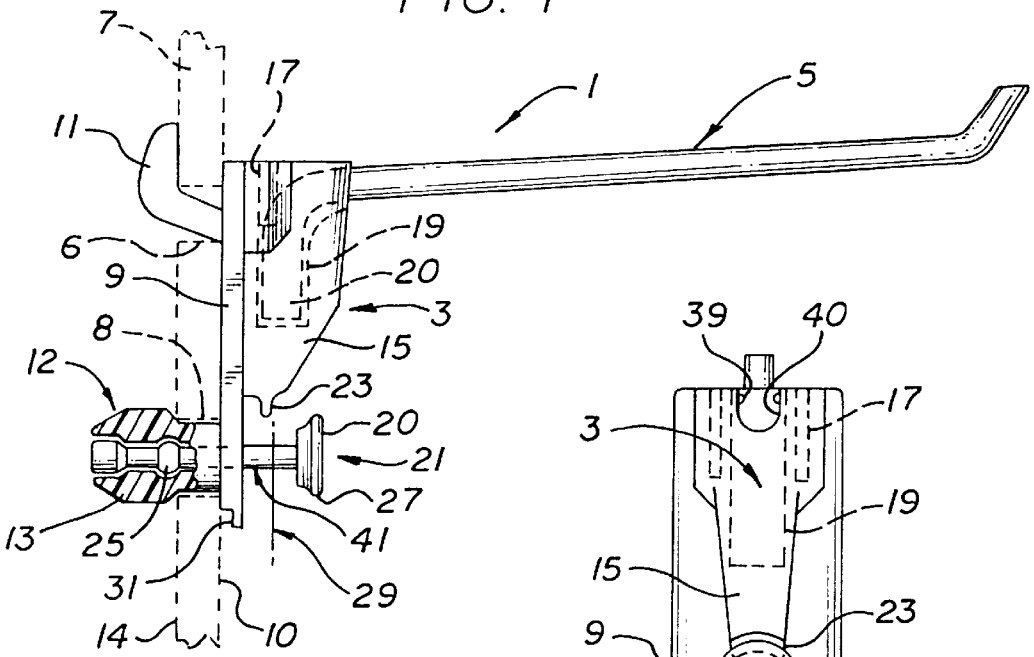
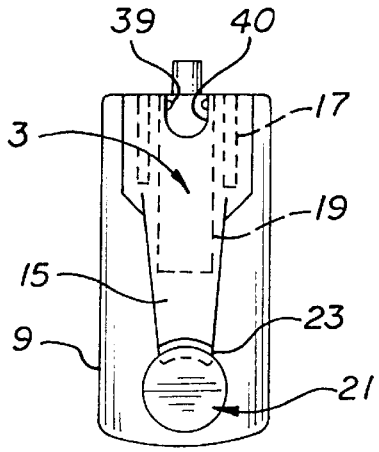
FIG. 3
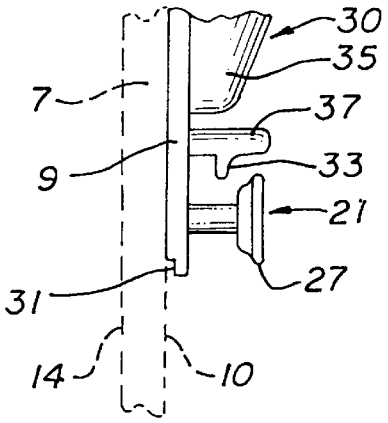
FIG. 2
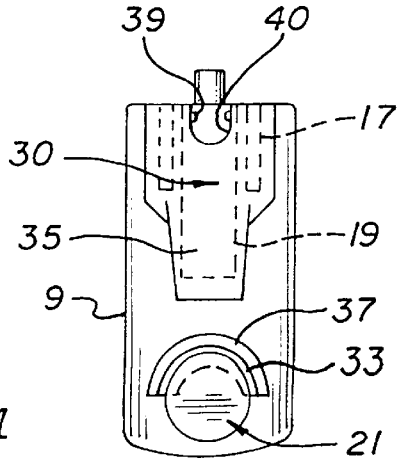
FIG. 4

FIG. 5
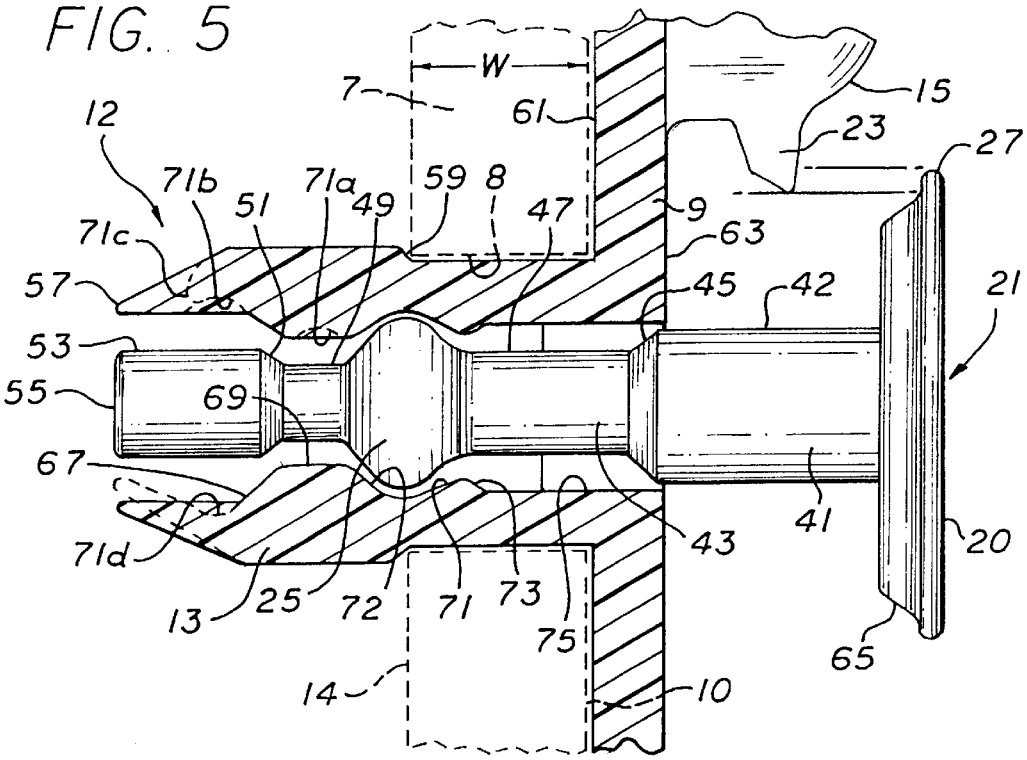
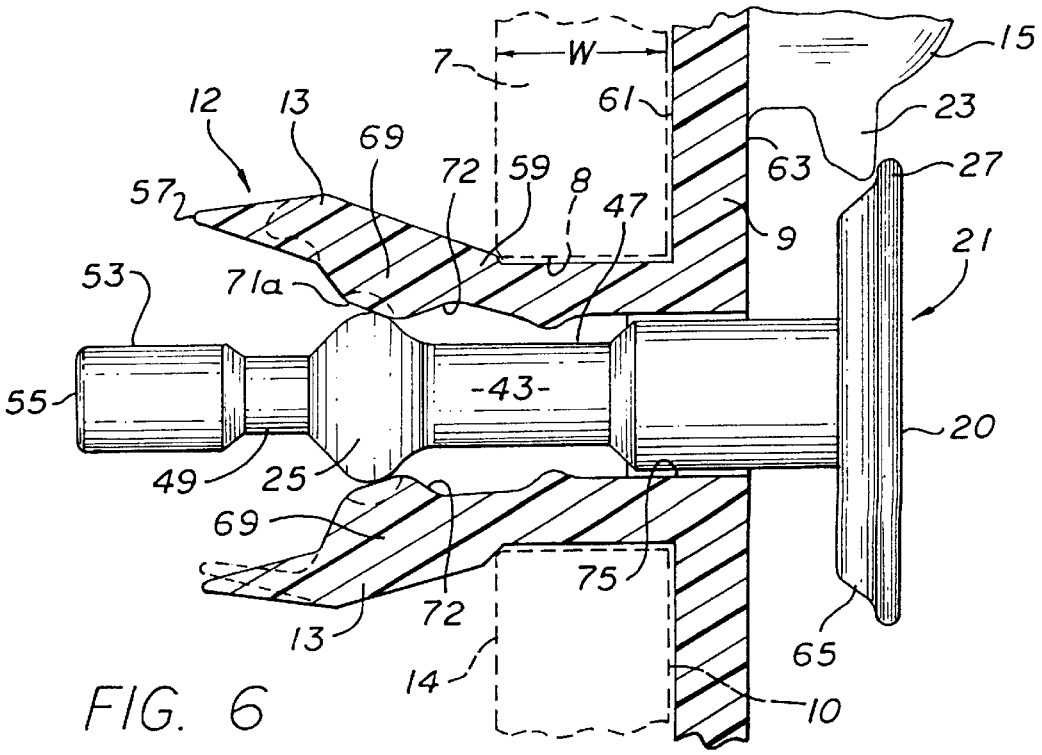
FIG. 6

FIG. 7
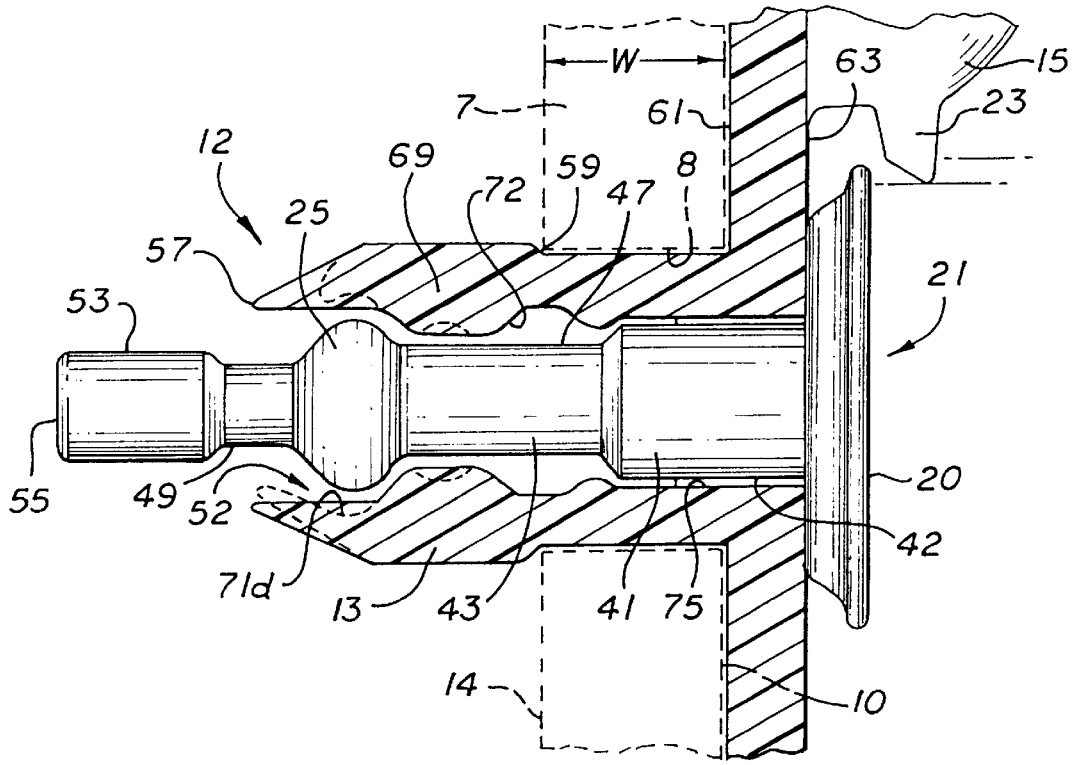
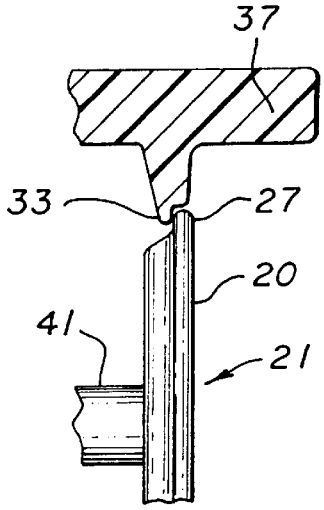
FIG. 8
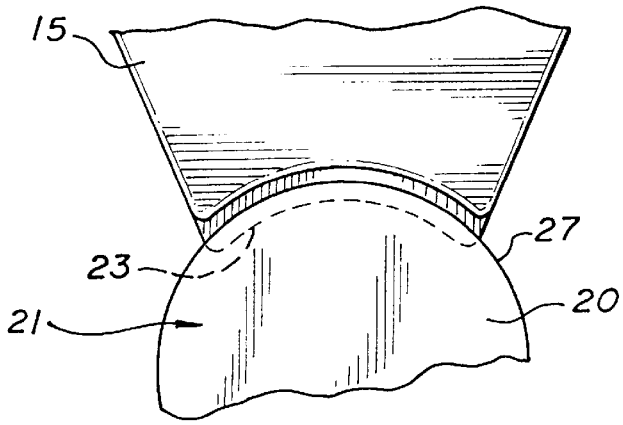
FIG. 9

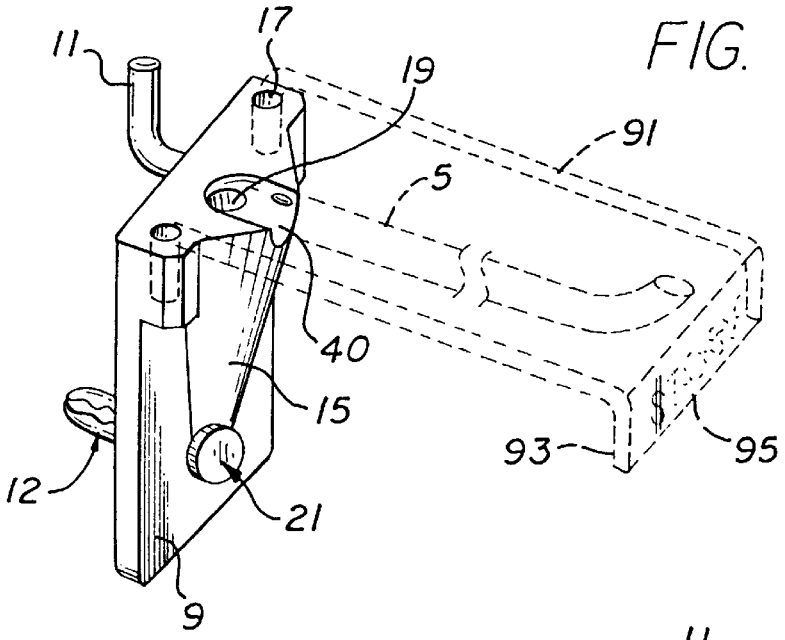
FIG. 10
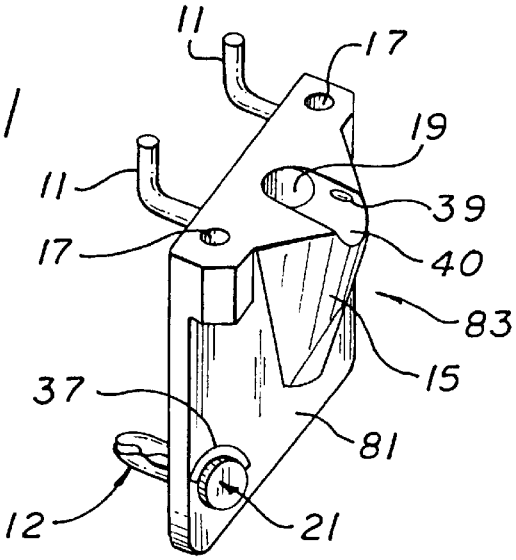
FIG. 11
FIG. 11a
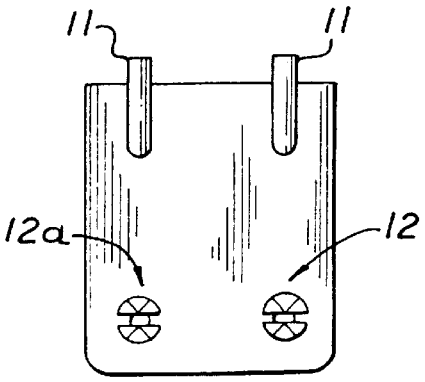
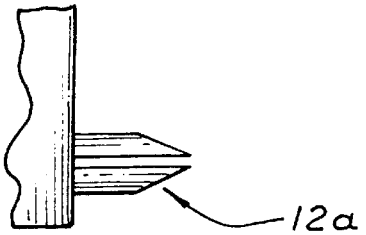
FIG. 11b

FIG. 16
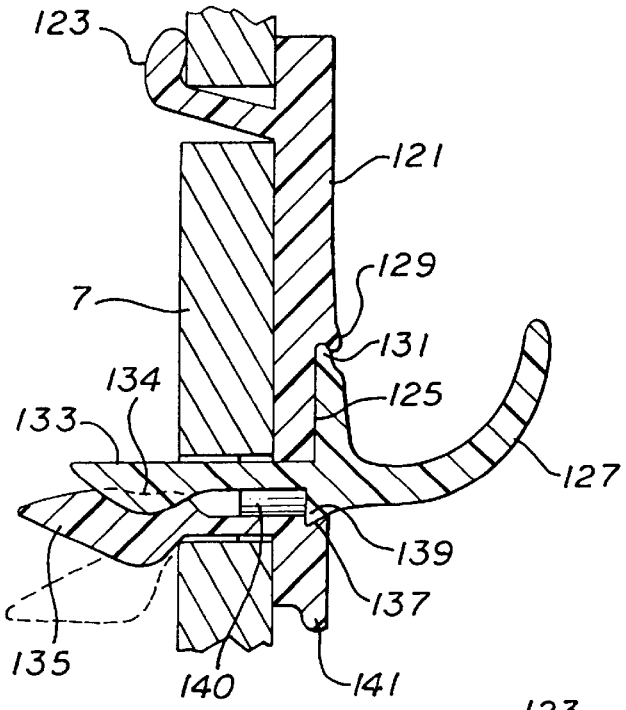
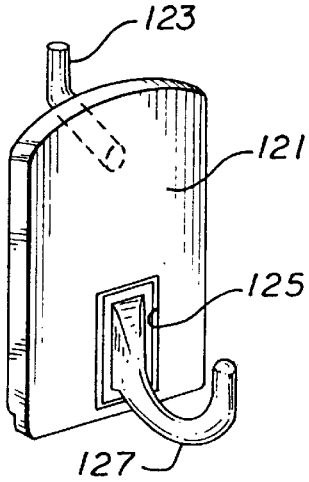
FIG. 15
FIG. 18
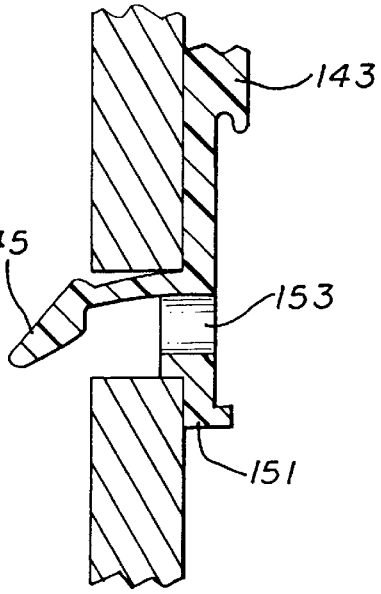
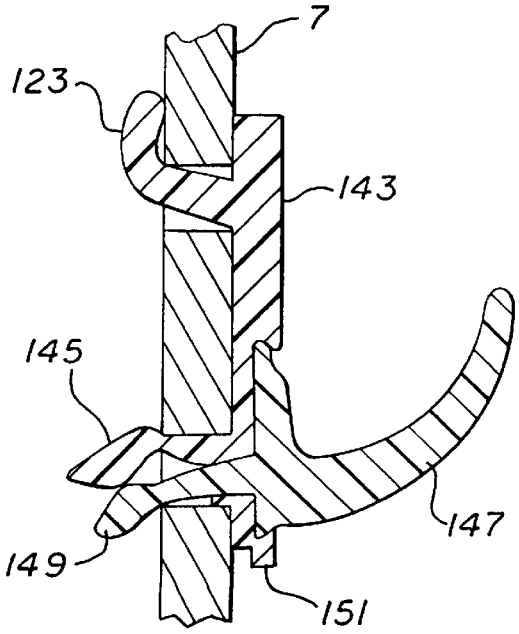
FIG. 17

FIG. 20
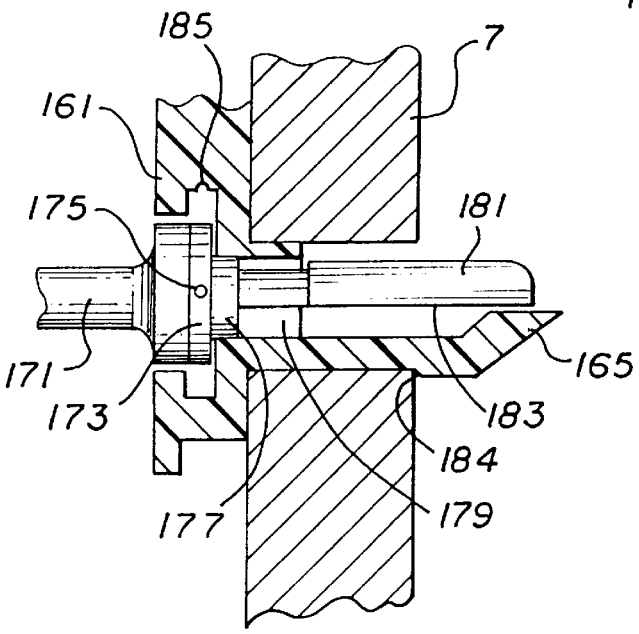
FIG. 19
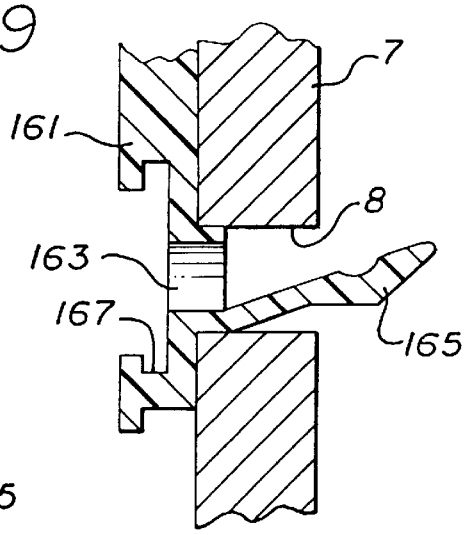
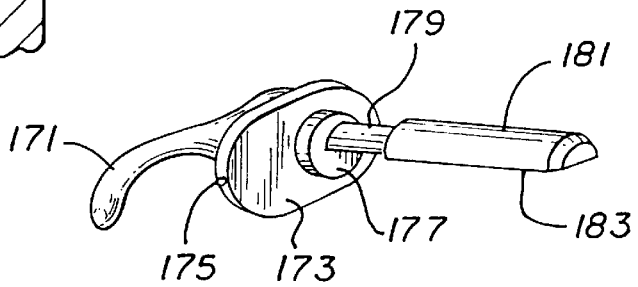
FIG. 21
FIG. 22
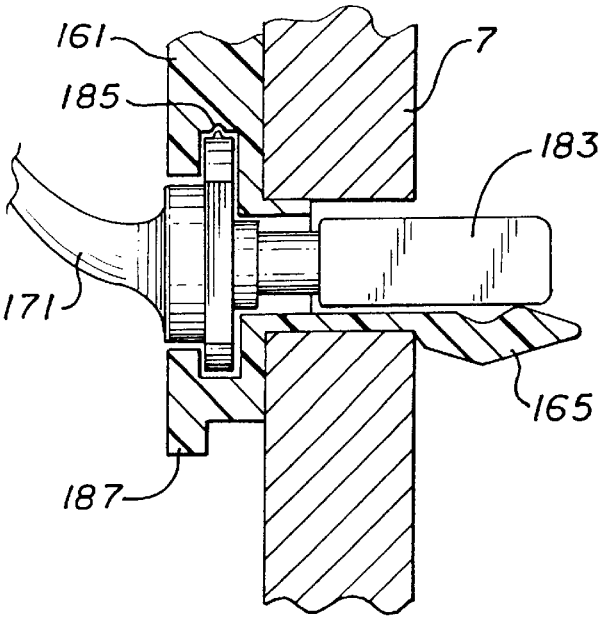
FIG. 20a
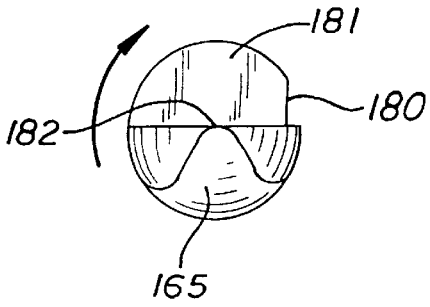

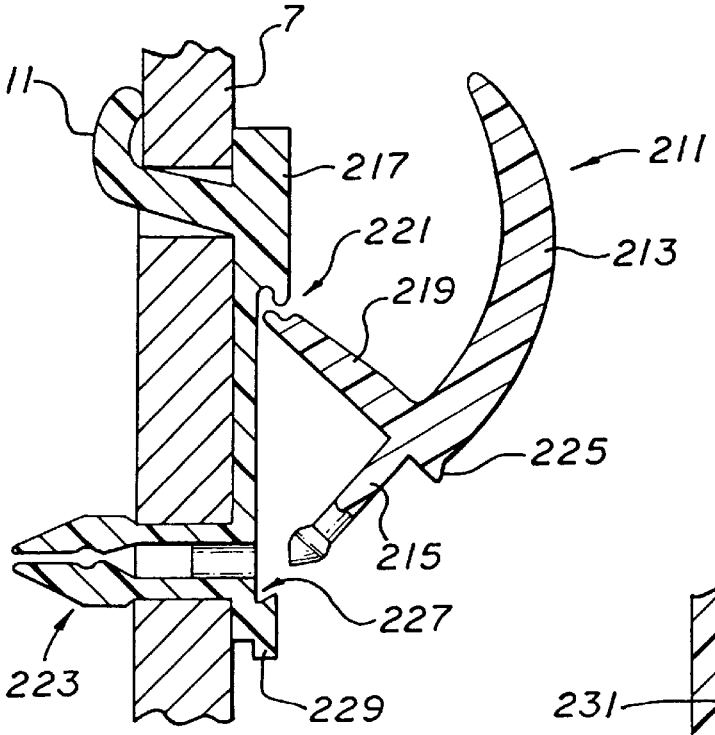
FIG. 26
FIG. 27
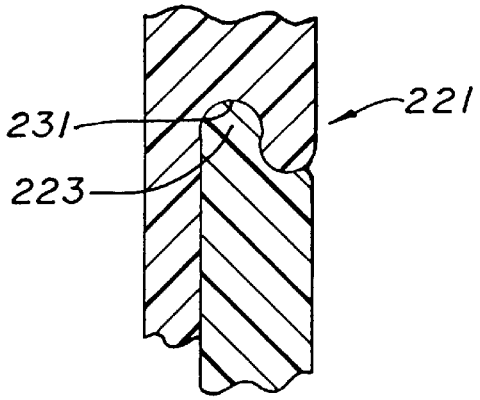
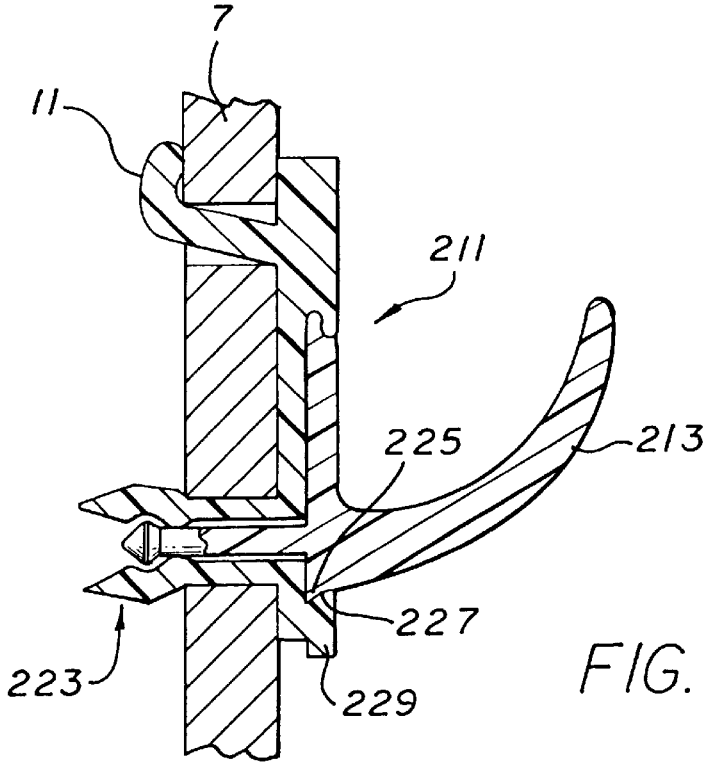
FIG. 28

FIG. 29
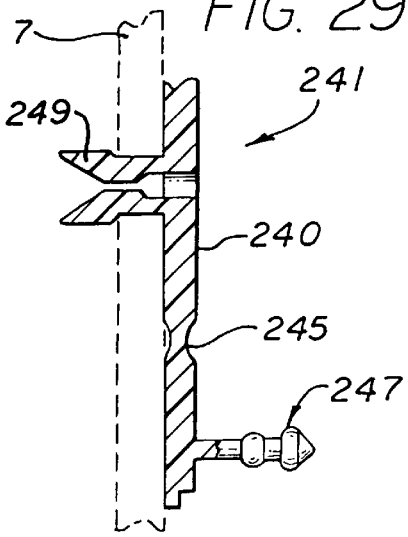
FIG. 30
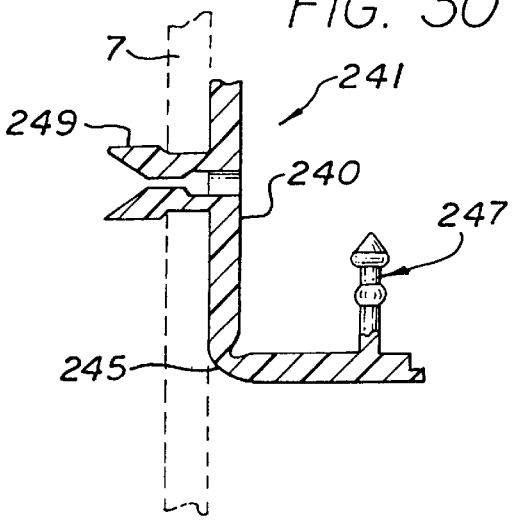
FIG. 31
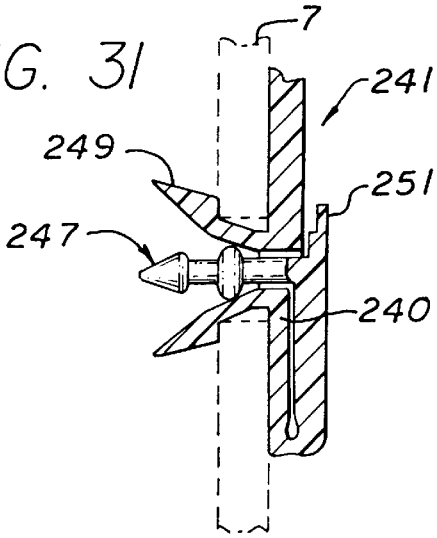
FIG. 32
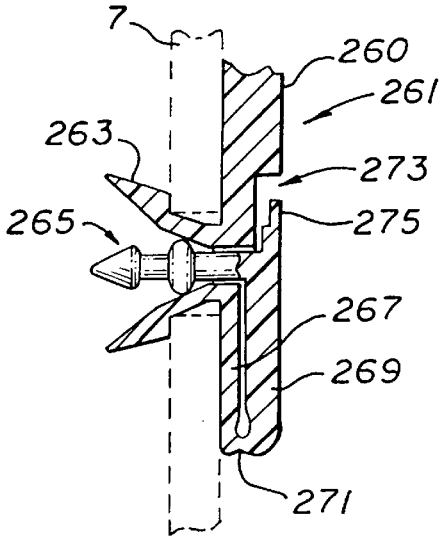
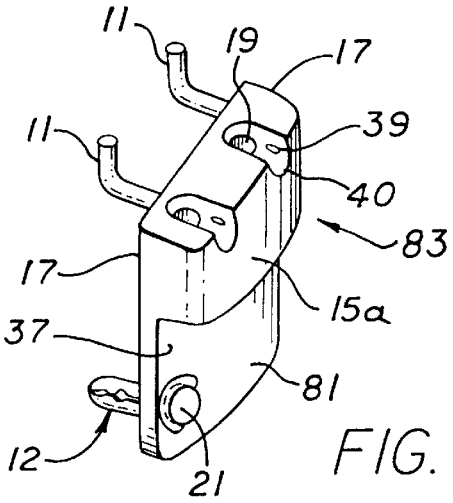
FIG. 33
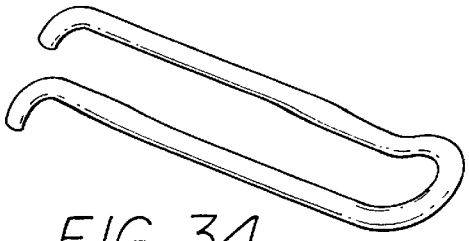
FIG. 34

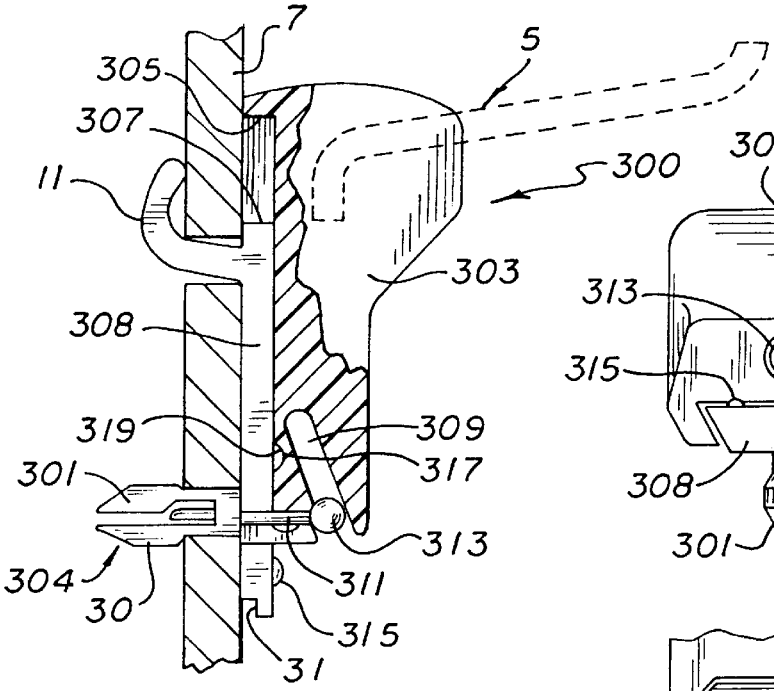
FIG. 35
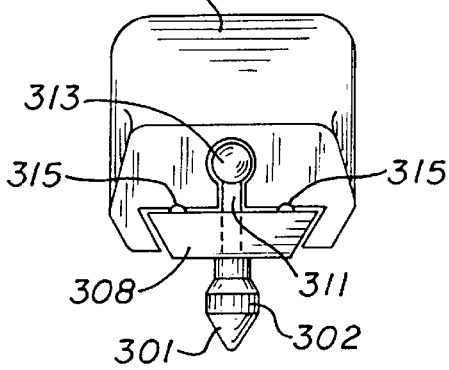
FIG. 36
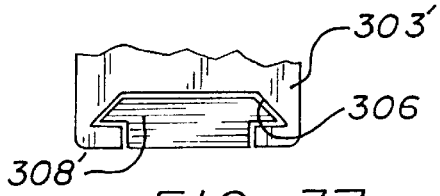
FIG. 37
FIG. 39
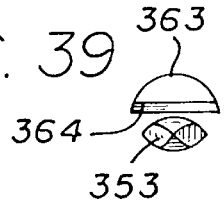
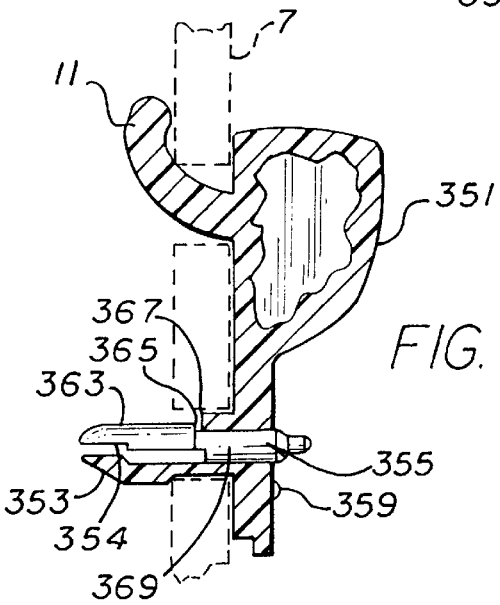
FIG. 38
FIG. 40
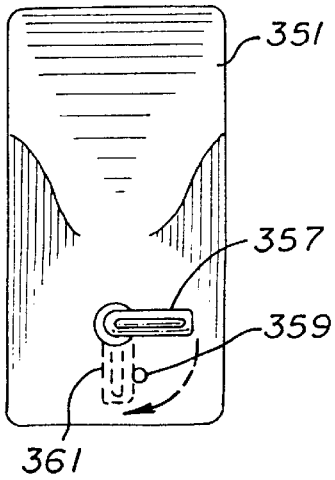

FIG. 45
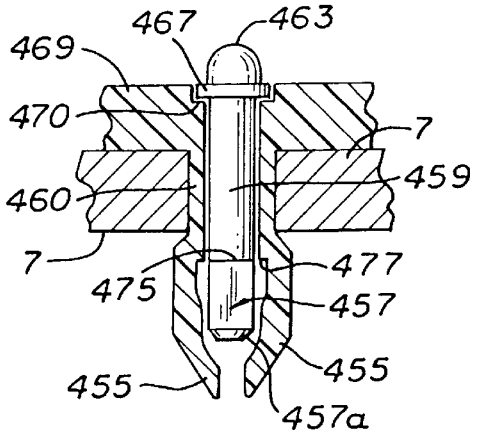
FIG. 45a
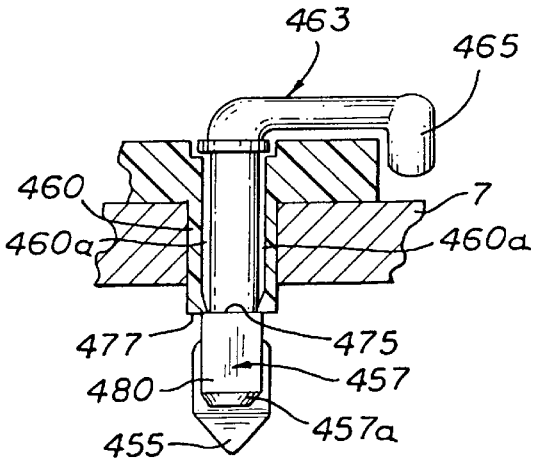
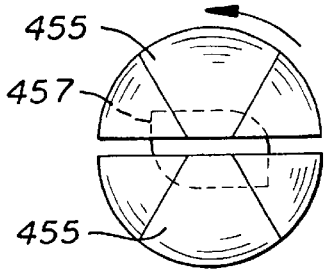
FIG. 46
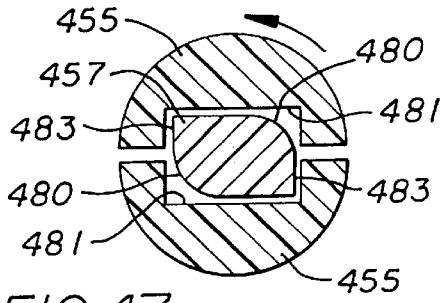
FIG.47
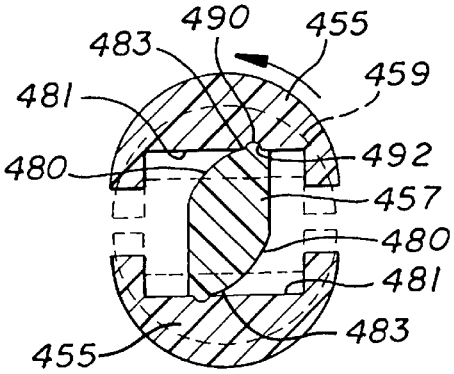
FIG. 48
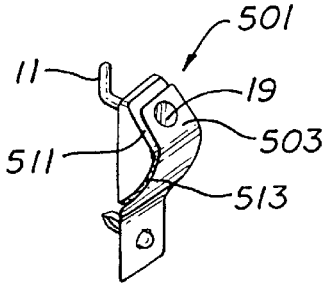
FIG. 49
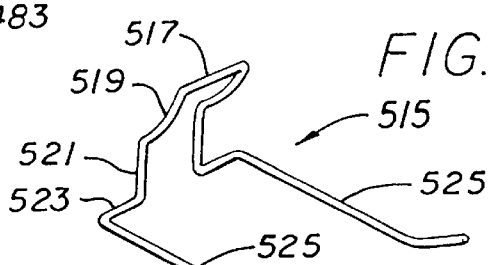
FIG. 50

FIG. 51
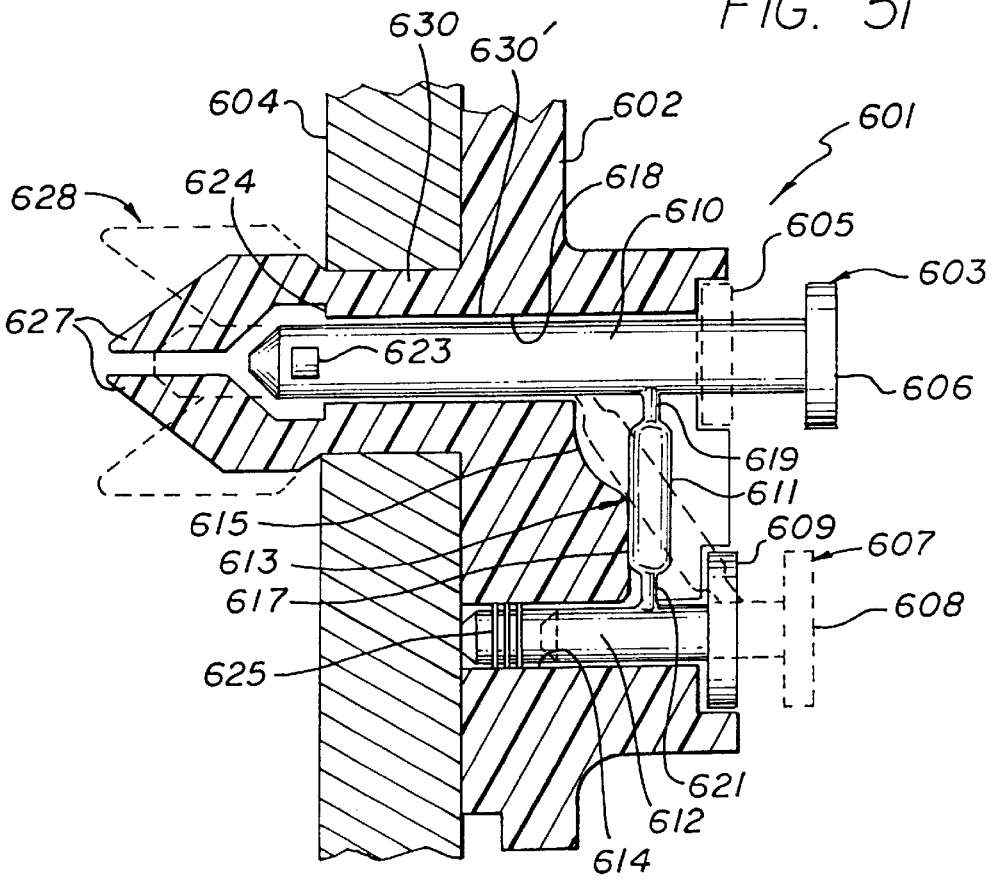
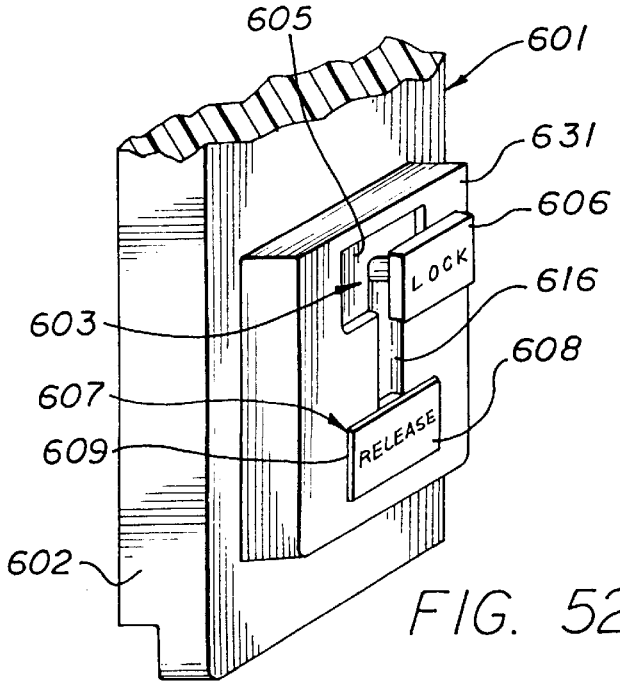
FIG. 52
FIG. 53
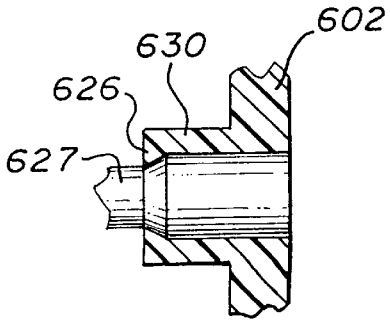

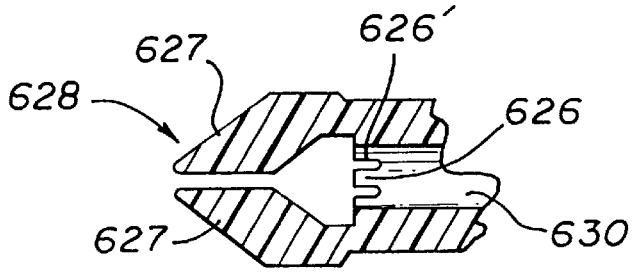
FIG. 54
FIG. 55
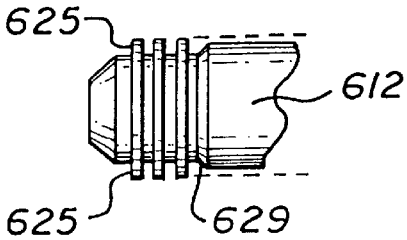
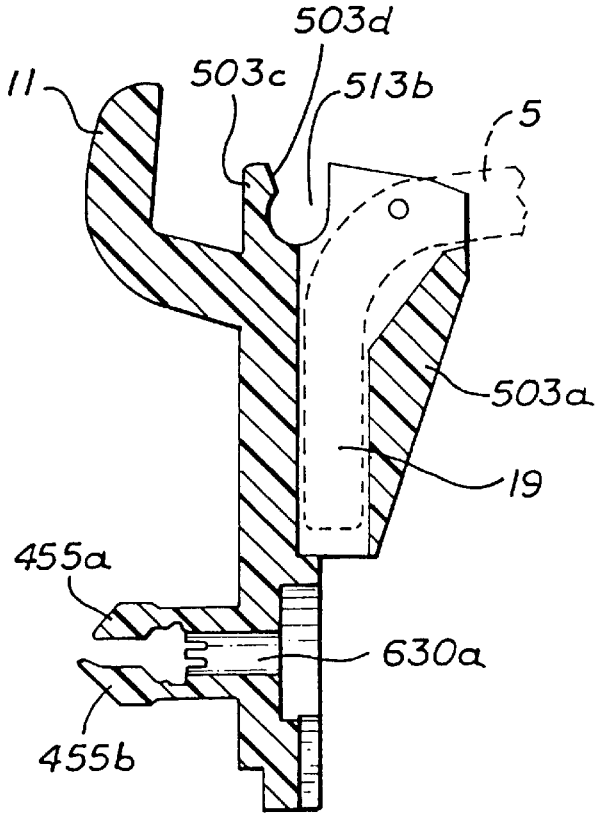
FIG. 56
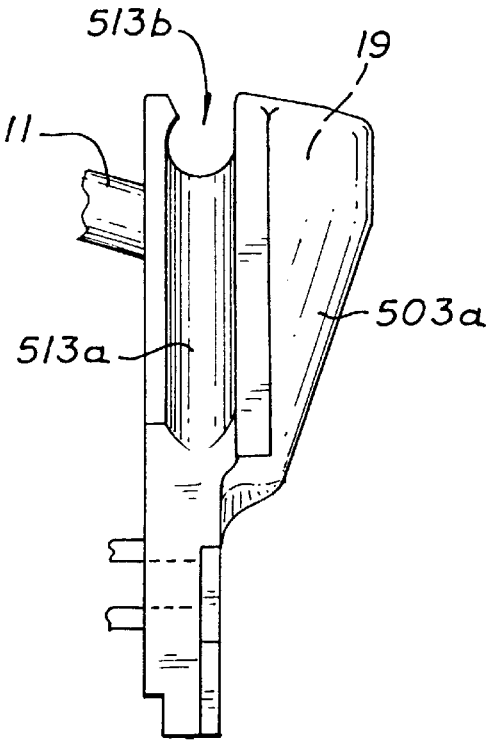
FIG. 57

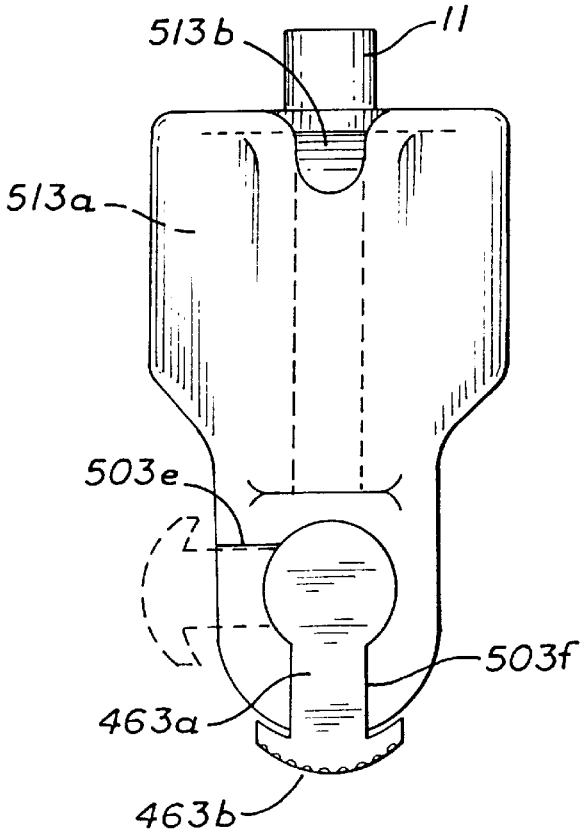
FIG. 58
FIG. 59
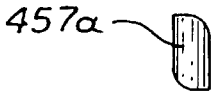
FIG. 59a
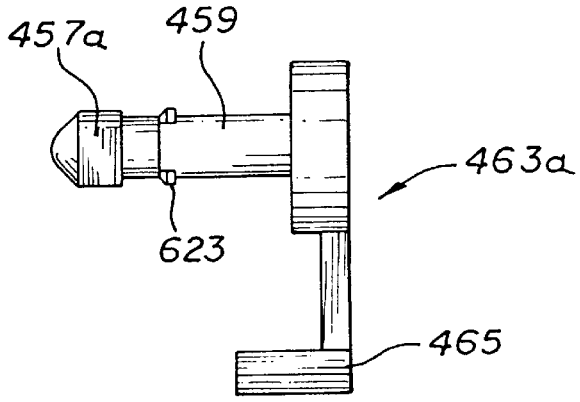
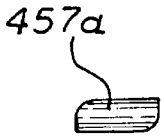
FIG. 60a
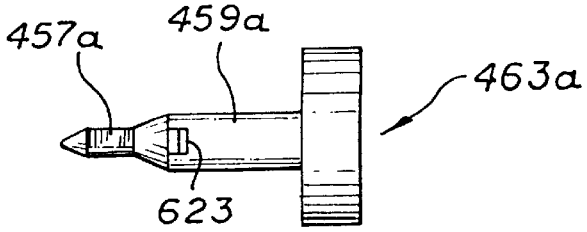
FIG. 60

FASTENER FOR HOLDING ITEMS TO A PERFORATED WALL

CROSS REFERENCE TO RELATED APPLICATION

This application is a continuation of Ser. No. 08/683,312 filed Jul. 18, 1996, now U.S. Pat. No. 5,855,347.

BACKGROUND OF THE INVENTION

1. Field of the Invention

This invention relates to fasteners, and more particularly to fasteners for holding items to a perforated wall, including, but not limited to, fasteners for consumer and commercial uses and in displaying collector items or goods for sale, or for supporting heavy items, or for supporting shelves, platforms, wire frames and similar items.

2. Brief Description of the Prior Art

A wide variety of useful fasteners for holding items to walls is available to the public and has been for many years. When attaching items to a perforated wall, the available fasteners are much fewer in number, and those that are available have many severe drawbacks. One exception is the perfboard toolholder fastener made in accordance with U.S. Pat. No. 5,407,160, the disclosure of which is incorporated herein by reference (discussed in detail hereinafter).

For convenience, in this specification, the term "item holder" will be used to represent a type of implement that is attachable to a perforated wallboard by insertion of an element into at least one hole and used to hold hand tools, garden tools, instruments, wires, cables, display objects (such as packages, blister display packs, vacuum display packs, loose hardware or household items, grocery items, department or variety store items, and shelves), pictures, wire frames, and the like. The term "item holder" will generally be used in place of more common terms such as "hook" or "toolholder", since "item holder" is considered generic to both of the former two terms.

The terms "wall", "wallboard", "pegboard," and "perfboard" shall be used interchangeably to represent that type of wall-like structure in which at least one hole is made and which accommodates and supports an item holder by means of insertion of a part of the item holder into the hole. These structures include what is commonly referred to as pegboards or perfboards, as well as paneling or wallboard into which at least one hole is made or formed.

The typical item holder for commercial uses is a straight single or double bar, usually extending from about four inches to about fourteen inches from the perforated wallboard. An item holder of this type usually has a pair of bent rod-like offset hooked portions at its top which are inserted into horizontally adjacent holes by a pivoting action of the fastener to situate the top tip of the hooked portions behind the wallboard while allowing the lower part of the fastener to rest against the front surface of the wallboard.

While the use of a pair of hooked portions may inhibit rotation of the item holder, it does not avoid the frustration experienced when the item holder itself is pulled off the perfboard along with the item being removed from it. The consequences of such an event are numerous, the primary ones being the need for the store personnel to locate, rehang, or replace the fallen item holder, the obvious cleanup, restocking, and cost problems associated with damaged goods, and, most importantly, the loss of goodwill on the part of the customer who, in addition to being frustrated, may also be embarrassed by the experience. Those who encounter such fasteners or holders for hanging items experience frustration and irritation upon attempting to remove the item from the fastener, since the bottom portion of the fastener is easily pulled away from the wall surface, i.e., there is no provision for fixing it to the perfboard.

Those who use perforated boards (sometimes referred to as pegboards, a pressed board material with regularly spaced perforations into which hooks may be inserted for the storage or display of tools, instruments, and other articles) are familiar with the frustration and irritation involved with an insecure hook. In a commercial environment, not only do the fasteners pull off the wallboard and get lost or damaged, especially when only one or two items are left hanging from an item holder, but fragile items, such as tea or coffee cups, can easily be broken when a shopper inadvertently tugs too hard or bumps the item holder, and causes the item holder to be dislodged from the perfboard, which is very easy to do.

Accordingly, there is a need in the art for a fastener of the type described above which is devoid of the many faults associated with insecure wall fasteners. Another major problem with prior art item holders is that, because of the need to suspend the item holder from two horizontally adjacent holes, an expensive weld is needed in order to attach a central item holding rod or framework. The present invention provides a fastener for attachment to a perforated wall which overcomes all of the aforementioned deficiencies. The need for the invention is paramount in the commercial field, where items are supported on rigid, long, straight bars for convenient inspection and handling by consumers and for high visibility of displayed consumer items to be purchased.

With the problem of locking an item holder (or toolholder) to an apertured wall solved by the present invention, the design of the inserted hanger portion for the item holder can take on any number of forms, in addition to long rigid straight bars. Additionally, any wire rod or frame construction can be formed out of wire of an optimum diameter and not restricted to a wire size related to the hole size in the perfboard.

Accordingly, with the aforementioned problems solved, there will emerge a need for hangers or supports of varied configurations, including long vertically oriented hooks, large diameter horizontal loops, box-like attachments for containing small parts, U-shaped hangers for accommodating tools or other items between the legs of the U-shaped hinge having a bight portion extending outwardly from the board, and the inwardly directed end of the hanger being fixed to the wall fastener body. For even more specialized applications, for example in supporting carpenter's planes, sanders, routers, and other hand and power tools which have wide bases, a wire frame arrangement may be constructed to provide a secure, optionally railed, platform for maintaining the tool in place, with an extension from the hanger adapted to be attached to the body of a fastener locked to the wall of the board in accordance with the present invention. In this field of application, it would be clear to the person skilled in the art of wall fasteners that hanging tools and the like are simply examples of items that can be supported by or from such hangers, and in the latter example, model airplanes, cars, boats, etc. can be mounted for visual display with the wire frame supports being color coordinated with the item displayed. Panels, decals, or other enhancement features fixed to the wire frame will enhance the visual appearance thereof or give more significance to the displayed item. In the latter case, for example, a title for the item being displayed, a date, a creator's name, etc. can be beneficially employed in this aspect of the invention.

For the purposes of this description, the term "pin" is meant to include any elongated member made of any type of semi-rigid or rigid material, with or without threads, with or without a shaped contour, and with or without a head portion. In this description, the term "plunger" will include a pin and pin head combination. When used in describing certain aspects of the present invention, the term "plunger" may be used synonymously with the word "pin" and has the same meaning.

SUMMARY OF THE INVENTION

According to one embodiment of the present invention, there is provided an item holder for holding items to a perforated wall having at least one hole passing therethrough from a front wall planar surface to a parallel rear wall planar surface, the item holder comprising a base member having a fastener insertable into the at least one hole from the front wall planar surface toward the rear wall planar surface, the fastener comprising: a projection having an axis preferably, but not necessarily, perpendicular to the planar wall surfaces and an axially extending passageway, at least a portion of the projection being displaceable laterally of its axis; and an elongated plunger insertable into the passageway in an insertion direction; the plunger displacing the projection portion laterally of the projection axis when the plunger is positioned in the passageway at a first axial position, the plunger releasing displacement of the projection portion laterally of the axis when the plunger is positioned in the passageway at a second axial position, the second axial position being spaced from the first axial position in the insertion direction.

In another aspect of the invention, there is provided a method of installing and removing an item holder adapted for holding items to a perforated wall having at least one hole passing therethrough from a front wall planar surface to a parallel rear wall planar surface defining an insertion direction, the item holder including a base member having a fastener insertable into the at least one hole in the insertion direction, the fastener including a projection having an axis and having an internal axial passageway therein, the fastener including a moveable plunger, the method comprising the steps of: installing the item holder on the perforated wall by inserting the rejection into the at least one hole in the insertion direction until the base member contacts the front wall planar surface, moving the plunger into the passageway generally in the insertion direction and displacing a portion of the projection laterally of the projection axis when the plunger is positioned in the passageway at a first axial position; and releasing the item holder from the perforated wall by positioning the plunger in the passageway at a second axial position, the second axial position being axially displaced from the first axial position in the insertion direction, and removing the projection from the at least one hole.

According to another embodiment of the present invention, there is provided an item holder for holding items to a perforated wall having at least one hole passing therethrough from a front wall planar surface to a parallel rear wall planar surface, the item holder comprising a base member having a fastener insertable into the at least one hole from the front wall planar surface toward the rear wall planar surface, the fastener comprising: a projection having an axis and having an axially extending passageway therein, at least a portion of the projection being displaceable laterally of the projection axis; and a crank having an elongated shaft insertable into the passageway; the crank shaft comprising a first camming surface and the projection portion comprising a second camming surface, the first camming surface cooperating with the second camming surface for displacing the projection portion laterally of the projection axis when the shaft is positioned in the passageway at a first rotational position, the first camming surface releasing displacement of the projection portion laterally of the projection axis when the shaft is positioned in the passageway at a second rotational position.

In another aspect of the invention, there is provided a method of installing and removing an item holder adapted for holding items to a perforated wall having at least one hole passing therethrough from a front wall planar surface to a parallel rear wall planar surface defining an insertion direction, the item holder including a base member having a fastener insertable into the at least one hole in the insertion direction, the fastener including a projection having an axis and having an internal axially extending passageway therein, at least a portion of the projection being displaceable laterally of the projection axis, the fastener including a crank having a rotatable shaft and comprising a first camming surface, the projection comprising a second camming surface, the method comprising the steps of: installing the item holder on the perforated wall by inserting the projection into the at least one hole in the insertion direction until the base member contacts the front wall planar surface; rotating the crank shaft in one direction to engage the first camming surface with the second camming surface, thereby moving the projection portion laterally of the projection axis, the first and second camming surfaces cooperating upon rotation of the crank in the opposite direction tending to disengage the first and second camming surfaces.

According to another embodiment of the present invention, there is provided an item holder for holding items to a perforated wall having at least one hole passing therethrough from a front wall planar surface to a parallel rear wall planar surface, the item holder comprising a base member having a fastener insertable into the at least one hole from the front wall planar surface toward the rear wall planar surface, the fastener comprising: a projection having an axis and having an axially extending passageway therein, at least a portion of the projection being displaceable laterally of the projection axis; and a crank having an elongated shaft insertable into the passageway, the shaft movable axially for selectively engaging the fastener portion and thereby selectively displacing the projection portion laterally; the crank having an arm extending perpendicular to the shaft, the arm comprising a first camming surface and the base member comprising a second camming surface, the first camming surface cooperating with the second camming surface for moving the shaft axially , the shaft releasing displacement of the projection portion laterally of the projection axis when the shaft is positioned in the passageway at a second rotational position.

In this embodiment of the invention, the shaft of the crank may be pushed into engagement with the projection portion and cammed out of engagement. Alternatively, the base member may have two camming surfaces, one to move the shaft axially in the insertion direction and one to move the shaft in the opposite axial direction.

In another aspect of the invention, there is provided a method of installing and removing an item holder adapted for holding items to a perforated wall having at least one hole passing therethrough from a front wall planar surface to a parallel rear wall planar surface defining an insertion direction, the item holder including a base member having a fastener insertable into the at least one hole in the insertion direction, the fastener including a projection having an axis and having an internal axially extending passageway therein, at least a portion of the projection being displaceable laterally of the projection axis, the fastener including a crank having an elongated shaft insertable into the passageway, the shaft movable axially for selectively engaging the fastener portion and thereby selectively displacing the projection portion laterally, the method comprising the steps of: installing the item holder on the perforated wall by inserting the projection into the at least one hole in the insertion direction until the base member contacts the front wall planar surface; moving the crank shaft in the insertion direction to engage and move the projection portion laterally of the projection axis; and rotating the crank arm in the opposite direction and engaging the first and second camming surfaces tending to move the shaft out of engagement with the fastener portion.

In another aspect of the invention, there is provided an item holder for holding items to a perforated wall having at least one hole passing therethrough from a front wall planar surface to a parallel rear wall planar surface defining an insertion direction, the item holder including a base member having a fastener insertable into the at least one hole in the insertion direction, the fastener comprising: a projection having an axis and having an internal axially extending passageway therein, at least a portion of the projection being displaceable laterally of the projection axis; and a plunger movable axially to selectively engage and displace the projection portion laterally of the projection axis; the item holder further comprising a sliding body having a camming surface, the sliding body slidably coupled to said base member and slidable in one direction to engage the camming surface with the plunger, thereby moving the plunger in the insertion direction and moving the projection portion laterally of the projection axis.

In this embodiment of the invention, the sliding body may have a second camming surface cooperating with the plunger upon sliding of the body in the opposite direction tending to disengage the plunger from the projection portion.

In another aspect of the invention, there is provided a method of installing and removing an item holder adapted for holding items to a perforated wall having at least one hole passing therethrough from a front wall planar surface to a parallel rear wall planar surface defining an insertion direction, the item holder including a base member having a fastener insertable into the at least one hole in the insertion direction, the fastener including a projection having an axis and having an internal axially extending passageway therein, at least a portion of the projection being displaceable laterally of the projection axis, the fastener including a plunger movable axially to selectively engage and displace the projection portion laterally of the projection axis, the item holder further comprising a sliding body having a camming surface, the method comprising the steps of: installing the item holder base member on the perforated wall by inserting the projection into the at least one hole in the insertion direction until the base member contacts the front wall planar surface; sliding the body in one direction to engage the camming surface with the plunger, thereby moving the plunger in the insertion direction and moving the projection portion laterally of the projection axis, the body having a second camming surface cooperating upon sliding of the body in the opposite direction tending to disengage the plunger from the projection portion.

BRIEF DESCRIPTION OF THE DRAWING

The invention will now be described with reference to the accompanying drawings showing preferred embodiments of the invention and with reference to which a detailed description of the invention will be given. In the drawings:

FIG. 1 is a side view of an item holder mounted on a perforated board (shown in phantom) comprising a holder body inclusive of a fastener shown in partial cross section, and an item hanger in accordance with one embodiment of the present invention;

FIG. 2 is a partial side view of the item holder as shown in FIG. 1, except that a different means of providing a stop for the plunger is depicted;

FIG. 3 is a front view of the item holder embodiment of FIG. 1;

FIG. 4 is a front view of the item holder employing the modificion shown in FIG. 2;

FIG. 5 is a partial cross sectional view of the fastener portion of the item holder of FIG. 1 showing the details of the fingers and plunger elements comprising the fastener;

FIG. 6 is a partial cross sectional view showing the fastener portion as depicted in FIG. 5 with the plunger in the locked position;

FIG. 7 is a partial cross sectional view showing the fastener portion as depicted in FIG. 5 with the plunger in the released position;

FIG. 8 is a partial cross sectional view of the plunger head and stanchion, i.e. flexible stop member, according to the embodiment of FIG. 2;

FIG. 9 is an enlarged view of a portion of FIG. 4 showing the relationship between the head of the plunger and the stanion support of FIG. 2;

FIG. 10 is a prospective view of the item holder according to FIG. 1 with additional outrigger cavities for supporting an extension from the body of the item holder, the extension being shown in phantom;

FIG. 11 is a perspective view of a modification of the embodimet according to FIG. 1, employing two bent extensions as opposed to the one extension shown in FIGS. 1 and 3;

FIG. 11*a* is a view of the rear of the embodiment of the invention according to FIG. 11;

FIG. 11*b* is a partial left side view of the item holder depicted in FIG. 11*a* showing the configuration of the dummy projection on the rear of the item holder;

FIG. 15 shows a perspective view of a further embodiment of the invention in which a replaceable item hanger fits within a receptacle in a base member, the base portion providing a part of the fastener mechanism, and the item hanger providing a second part of the fastener mechanism;

FIG. 16 is a cross sectional view illustrating, in cross section, one possible configuration to implement the item holder shown in FIG. 15;

FIG. 17 is a cross sectional view illustrating another possible configuration to implement the item holder shown in FIG. 15;

FIG. 18 is a cross sectional view showing the base member of the item holder of FIG. 17;

FIG. 19 shows, in cross section, a portion of the base member of the item holder shown in FIG. 16;

FIG. 20 is a partial cross sectional view showing yet another embodiment of the invention in which an item hanger is rotatable to lock the item holder to a perforated wall;

FIG. 20*a* is a rear view of just the fastener portion of the item holder shown in FIG. 20;

FIG. 21 is a perspective view of the item hanger of the embodiment of the invention shown in FIG. 20;

FIG. 22 is a partial cross sectional view showing the item holder depicted in FIG. 20 with the item hanger being rotated to lock the item holder to the perforated wall;

FIG. 26 shows a cross sectional view of the embodiment of the invention similar to that of FIG. 24 except that the item hang and base member have a cooperating hinging action without being integrally connected;

FIG. 27 is a cross sectional view of a portion of the arrangement according to FIG. 26 showing the hinge feature;

FIG. 28 is a cross sectional view illustrating the embodiment of the invention of FIG. 26 with the item holder hinged down into a locking position;

FIG. 29 shows, in partial cross section, a monolithic fastener portion for an item holder in which the pin can be pivoted about a thinned portion and into the fastener for locking the fastener to a perforated wall;

FIG. 30 is a partial cross sectional view of the embodiment of the invention of FIG. 29 with the pin portion pivoted part way to its locking position;

FIG. 31 is a partial cross sectional view of the embodiment of FIG. 29 with the pin swung fully into the locked position;

FIG. 32 shows, in partial cross section, an embodiment similar that of FIG. 31, except that the segment of the base containing the pin lies flush with a cavity in the remaining part of the base portion of the item holder;

FIG. 33 is a perspective drawing of an alternate embodiment the invention configured as a 4-hole wall item holder having a holder body with a double hanger-bar capacity;

FIG. 34 is a perspective view of a U-shaped metal bar representing one of a variety of item hangers which will fit into the double hanger bar holder body of FIG. 33;

FIG. 35 shows, in partial cross section, an alternative embodiment of the invention in which a sliding body mounts to a base portion and cams a plunger in and out of a fastener of the base portion as the body slides on the base portion;

FIG. 36 is a bottom view of the embodiment shown in FIG. 35;

FIG. 37 is a partial view of an alternative sliding dovetail arrangement between the sliding body and base portion shown in FIG. 35;

FIG. 38 shows, in partial cross section, a further embodiment of the invention in which a crank is rotatable within a body portion, the end of the crank cooperating with a fastener for locking the fastener to the perfboard as the crank is rotated, the crank being shown in the unlocked position;

FIG. 39 is an end view of just the crank shaft and fastener fingers as would be seen looking toward the rear of the embodiment according to FIG. 38;

FIG. 40 is a front elevational view of the arrangement shown in FIG. 38 with the crank handle shown in the unlatched position in solid lines and in the latched position shown in dashed lines;

FIGS. 45 and 45*a* are partial cross sectional views of a crank mounted in a base portion and locked against axial movement, yet rotatable about a crank shaft axis to cam the fingers of a fastener selectively outwardly;

FIG. 46 is an enlarged end view of just the fastener and crank shaft shown in FIG. 45 without showing any structure behind the fastener end, and with the crank shaft in the unlatched rotational orientation;

FIG. 47 is an enlarged cross sectional view taken along the lines 46—46 in FIG. 44 and also shows the crank shaft in the unlatched position;

FIG. 48 is a view similar to that of FIG. 47, but with the crank shaft rotated to cam the fingers of the fastener outwardly to press and lock against the rear of the perfboard on which the item holder is mounted;

FIG. 49 shows an embodiment of the invention similar to that shown in FIG. 1 with the addition of a grooved channel along the sides and top of the item holder body to accommodate a wire frame;

FIG. 50 shows a wire frame structure sized and configured to fit into the grooved channel of FIG. 49;

FIG. 51 shows a partial cross sectional view of another embodiment of the invention employing separate user-actuated lock and release actuators;

FIG. 52 is a partial perspective view of the item holder mechanism of FIG. 51;

FIG. 53 is a cross sectional view of a portion of the cylindrical wall of the fastener as would be viewed from the top of FIG. 51;

FIG. 54 is a cross sectional view of a portion of the cylindrical wall and fingers of the fastener as would be seen FIG. 51 with the plunger arrangement removed;

FIG. 55 is a partial view of the end of the release plunger shown in FIG. 51;

FIG. 56 is a side elevation view of a body part only of a further embodiment of the invention similar in function to that shown in FIGS. 44–48, with the crank handle located on the opposite side of the toolholder body;

FIG. 57 is a cross sectional view of the embodiment shown in FIG. 56;

FIG. 58 is a front elevation view of the embodiment shown in FIG. 56;

FIG. 59 is a side view of the crank to be inserted into and function with the body part shown in FIGS. 56–58;

FIG. 59*a* is an end view of the cam portion of the crank shown in FIG. 59;

FIG. 60 is a top view of the crank to be inserted into and function with the body part shown in FIGS. 56–58; and FIG. 60*a* is an end view of the cam portion of the crank shown in FIG. 60.

DETAILED DESCRIPTION OF THE PREFERRED EMBODIMENTS

Figure 12A:
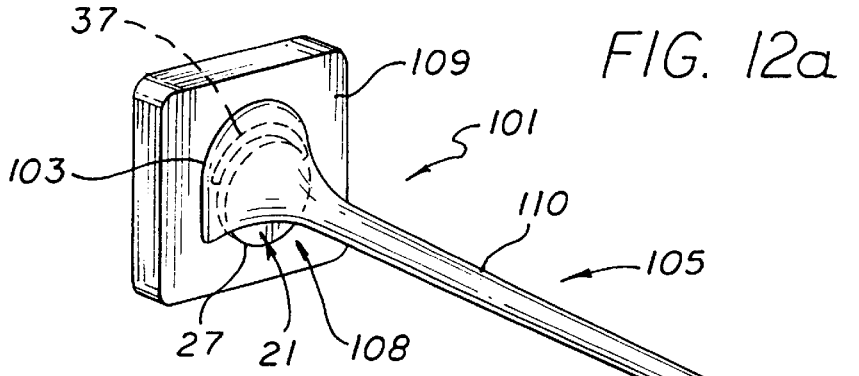
FIGS. 12*a* and 12*b* show alternative variations of an item holder that employs a lockable fastener according to the present invention but does not incorporate a bent extension for applying pressure against the rear of the perforated board upon which it is to be mounted.

One of the major goals of the present invention is to fix an item holder solidly to a perfboard without the need for tools to install it on or remove it from the perfboard. A number of different approaches or solutions to this problem will be presented. Further, since the need to install and remove item holders from a perfboard without the use of tools is essential to the commercial or industrial use of perfboard item holders, a parallel goal of the invention is to employ the "no tools needed" feature to a commercial or industrial type item holder, i.e., one that can accommodate heavy items, one that can support a large number of items along an elongated projection or bar, one that can support a wire frame structure of any of a variety of different configurations, and/or one that can be installed on, and removed from, a perfboard quickly and easily.

FIG. 1, for example, shows an item holder 1 that satisfies all of the above-stated goals. It provides a means for solidly fixing the item holder 1 to a perfboard 7 while accepting a selected, replaceable elongated rod, preferably of, but not limited to, metal for hanging heavy, or a large number of, items on a perforated board or wall. It will be understood that, instead of a straight rod, any of a variety of item hangers can be held by the described holder body 3, including wire racks or frames. A rod will be shown and described herein for purposes of convenience.

FIG. 1 depicts one preferred embodiment of the invention in the form of an item holder 1 having a holder body 3 supporting a separate elongated rod 5, the body 3 being mountable on a perfboard 7. Body 3 has a base portion 9 having an offset hook-like member 11 projecting from the rear of base portion 9 and a button fastener 12 also projecting from the rear of base portion 9, both projections 11 and 12 passing through perfboard 7 from a front wall surface 10 to a rear wall surface 14. The offset member 11 is shown passing through an upper hole 6 in perfboard 7, while the button 12 is shown passing through a bottom hole 8. For this embodiment, and for all other embodiments to be discussed herein, the perforated board or wall 7 may be a board or wall with one or more holes or may be a board with an organized matrix of spaced holes defining what is commonly referred to as a pegboard.

Button 12 is preferably integrally formed with base portion 9, although it could also be an insert attached to base portion 9 by any known means of attaching a generally cylindrical or polygonally shaped member to a flat base member. As shown, button 12 includes a pair of fingers 13 constructed in a manner similar to those shown and described in the aforementioned U.S. Pat. No. 5,407,160. However, the interior surfaces of fingers 13 according to the present invention are unique and serve a purpose to be described hereinafter in detail.

As used in this description, the term "passageway" will mean the central axial opening in button 12 through which a pin or plunger, such as that shown at 21 in FIG. 1, may pass. The "passageway" is not limited to being cylindrical and may be radially complex in shape along its axis, as desired for any particular application. It may be formed by a finger or fingers 13 of a button fastener 12 and/or the base portion 9, and/or a body portion 3 of an item holder.

The main part of the holder body 3 is configured as a hanger adapter 15, termed so because it accommodates different configurations of an item hanger 5 in a main bore 19 and/or in outrigger cavities 17, better viewed in the perspective view of FIGS. 10 and 11.

A plunger 21, having a head 20 and a pin 41, may be pushed toward the base portion 9 for expanding the fingers 13 with the bulge portion 25 of the pin 41 as the bulge portion 25 moves to the left as seen in FIG. 1. This operation spreads fingers 13 apart and locks the holder body 3 to the perfboard 7 in the same way as described in the aforementioned U.S. Pat. No. 5,407,160.

The position of plunger 21 shown in FIG. 1 is what may be referred to as a storage position, i.e., the position of the plunger of a newly molded holder body 3 prior to use. Due to the shape of the passageway interior of the fastener 12, the bulge 25 is captured by annular depressions (described hereinafter) in fingers 13 so as to hold plunger 21 in position without falling out during shipment and during handling by the end user prior to locking the holder body 3 to the perfboard 7.

When ready to install the holder body 3 on a perfboard 7, the offset hook-like member 11 is inserted into a top hole 6 of the perfboard 7, and the body 3 is swung downwardly until the fastener 12 is snapped into the bottom hole 8. The plunger 21 is then depressed toward the base portion 9 until the bulge 25 cams the fingers 13 outwardly and the head 20 of the plunger 21 stops upon engagement of flexible lip 27 of the plunger 21 with flexible stop member 23 of the holder body 3. Under this condition, the spread fingers 13 prevent button fastener 12 from being pulled out of the bottom hole 8, and the item hanger 5 is then inserted (although it could have been done earlier), and the item holder 1 is ready for use.

If and when the item holder 1 is to be removed from the perfboard, the user simply pushes in plunger 21 further, and with slight additional force than that required for pushing plunger 21 to its stopped position, the user pushes the head 20 past the engagement of lip 27 and stop member 23 until the head 20 is adjacent the front surface of base portion 9. In this condition, the bulge 25 has moved to the left (in FIG. 1) until it is past the thickened portion of fingers 13, allowing the fingers 13 to collapse, and the holder body 3 may be removed by pivoting the holder body 3 in a reversed direction from the mounting pivoting direction. The details of the button fastener 12 cooperating with pin 41 will be described below in connection with FIG. 5.

In FIG. 1, the flexible lip 27 of plunger 21 stops against flexible stop member 23 which is part of holder body 3. In order to allow for greater movement of the stop member 23 past which the lip 27 of head 20 must pass, the arrangement of FIG. 2 may be implemented. The stanchion 37 has a flexible lip 33, but since the stanchion 37 is not connected to the hanger adapter 35, in addition to the lip 33 flexing, the stanchion 37 itself may flex, permitting a longer length of lip 33 and/or stronger material to be used in molding the holder body 3, both offering a more secure stopping of the head 20 of plunger 21 when the latter is moved to the locked position.

In the front view of FIG. 3, the shape of the hanger adapter 13 is better observed, and the relative position of the main bore 19 and outrigger cavities 17 can be observed. Also, the top front of the hanger adapter 15 has a U-shaped horizontal channel 40 sized to snugly receive the innermost end of the horizontal portion of item hanger 5.

To install hanger 5, the held end 20 is inserted into main bore 19 until the adjacent horizontal portion of hanger 5 rests in the U-shaped channel 40. The vertical length of channel 40 is greater than the diameter of hanger 5 so as to permit a pair of barbs 39 to be formed at the upper portion of channel 40. As the held end 20 of hanger 5 fits deeper into bore 19, the horizontal portion of hanger 5 presses against barbs 39 and compresses them and/or spreads the sides of channel 40 slightly outwardly to permit hanger 5 to snap past barbs 39 and be snugly captured between barbs 39 at the top of the hanger 5 and the bight portion of channel 40 on the lower side of hanger 5.

Also seen in FIG. 3 is the shape of the flexible stop member 23 which, in a preferred embodiment, is arcuate for about 30 to 60 degrees of the head of plunger 21.

FIG. 4 shows the front view of the embodiment of the invention depicted in FIG. 2, wherein the hanger adapter 35 extends downwardly to be spaced from an arc-shaped stanchion 37 having a radially inwardly flexible lip segment 33. In this embodiment, the flexible lip segment 33 is arcuate for about 150° to 200° in a preferred embodiment, but may be as small as 30° when relatively stiff material is used.

Turning now to FIG. 5, the detailed operation of the button fastener 12 and plunger 21 combination will be described.

FIG. 5 shows the stored or reset position of the plunger 21. Plunger 21 has a neck 42 of a diameter substantially equal to the diameter of bore 75 in the base portion 9 so as to permit the neck 42 to move axially freely but with little lateral displacement.

The neck 42 reduces in diameter forming a pin shoulder 45 leading to a thinned neck extension 43 having an outer surface 47 the diameter of which is smaller than the inner diameter of the thickened portion 69 of fingers 13. As will be explained later, this dimensional relationship is necessary to permit the thickened portion 69 of fingers 13 to flex slightly inwardly, back to their reset condition, without being limited in movement by the outer surface 47 of neck extension 43 when pin 41 is pushed further into bore 75.

A bulge 25 of pin 41 is captured in annular reset depressions 71 of fingers 13 so that, once inserted, plunger 21 will not tend to fall out during shipment of the assembled item holder or during handling prior to mounting on a perfboard.

A finger shoulder 59 is provided so as to permit the button fastener 12 to be inserted into hole 8 of the perfboard 7 and temporarily held in a stable position until the user is satisfied that the item holder is to be subsequently locked in place at that position. The spacing between shoulder 59 and the rear surface 61 of base portion 9 is made substantially equal to the thickness W of the perfboard 7 and optionally slightly less than thickness W to prevent looseness of the fit.

As best seen in FIG. 6, when plunger 21 is pushed, as with the thumb of one's h and, the lip 27 stops against stop member 23. At this position of plunger 21, pin 43 is moved to the left until bulge 25 cams fingers 13 outwardly against camming surface 72 and stops at the maximum expansion of finger 13 due to the lip 27 stopping against stop member 23. In this position of the plunger 21, even though not fully inserted into button 12, it will not interfere with the use of the item hanger, since it typically will be at a distance from base portion 9 shorter than the maximum distance from base portion 9 hanger adapter 15 extends.

An improvement in latching security in the locked position of FIG. 6 can be realized by providing a detent 71*a* in the middle of the thickened finger portion 69, the concave depression 71*a* shown in phantom in FIGS. 5–7 being configured to conform to the outer shape of bulge 25. The interrelationship between bulge 25 and depressions 71*a* will keep the plunger 21 from moving out of the locked position due to the camming action of the spread fingers 13 applying axially directed forces against bulge 25. Of course, instead of a concave depression in the thickened fingers 69, a bump can be provided (not shown) which would fit into a groove (not shown) in bulge 25.

In order to release plunger 21 and permit fingers 13 to relax to their preformed condition for removal of the fastener 12 from hole 8, plunger 21 can simply be pulled backwards by one's finger or an appropriate prying tool. However, no tools are required to release the locked condition of the button/plunger engagement as will be understood by reference to the description of FIG. 7.

When it is desired to remove the fastener 12 and holder body 3 from the perforated wall 7, the user may once again push the plunger 21 using a thumb or finger causing pin 41 to extend yet further into button 12. This is the condition of the pin as seen in FIG. 7, where the interior surfaces of all portions of fingers 13 extending rearwardly of the perfboard 7 are spaced from pin 41. As a result, by lifting up on item hanger 5, the fingers 13 will move slightly inwardly due to the finger shoulders 59 moving against the edges of the hole 8 in perfboard 7. The spacing between the outer surface 47 of pin 41 and the thickened portions 69 of fingers 13 permit this collapsing of fingers 13 sufficiently to remove the button 12 from hole 8 without significant friction or impediment.

After the item holder is removed from the perfboard 7, it may be desired to replace the item holder at a different location on the perfboard 7. While this could be done in the state of the fastener shown in FIG. 7, there would be no easy way to move plunger 21 back to its locked position where the fingers 13 are spread apart against the back wall of perfboard 7. However, before the item holder is placed at its new location, one simply presses the reset knob 53 against any surface, such as a floor or tabletop, or uses one's thumb, and, in doing so, plunger 21 will be moved rearwardly within button 12 until the knob end 55 is flush with the tips of fingers 13, and at this position, the head 20 is moved back to its reset position as shown in FIGS. 1 and 5.

The solid lining shown in FIGS. 5–7 for fingers 13 illustrate one configuration of the fingers 13, while the phantom lines depict a second configuration. In both cases, the tips of the fingers 13 should be pointed so as to serve as guides by the button 12 as the holder body 3 is pivoted downwardly. The most critical of the two fingers for guiding into the hole 8, without contact with the front surface 10 of perfboard 7, is the lower finger 13, and for that reason, the distal end of the lower finger 13 is formed closer to the axis of plunger 21 which is permissible when the pin 41 is fully depressed (FIG. 7) due to the provision of the lower concave depression 71*d* in lower finger 13. The distal end 71*c* of the upper finger 13 is shown in phantom to be shorter and stubbier than that of the bottom finger, since it is the last of the fingers to reach hole 8, and the locking action is fully accomplished due to the thickened portions 69 of fingers 13, so that the shorter upper finger 13 is not detrimental to the functioning of the device.

It will be evident by reference to FIG. 7 that, in order to permit the fingers 13 to collapse sufficiently to clear the diameter of hole 8 while flexing of fingers 13 inwardly, annular (or planar if desired) concave end depressions 71*b* and 71*d* are provided in fingers 13, thereby permitting fingers 13 to collapse inwardly and more closely follow the contour of pin 41, thereby allowing the diameter of the fingers 13 to diminish as the fingers 13 are removed from hole 8.

One of the important features of the invention is that the plunger 21 is preset in position, either at the molding facility or in a subsequently assembly operation, so that the user has simply to push the plunger 21 in with a thumb or finger to both lock the item holder to the perfboard and to release it from the perfboard. For better quality assurance in assembling the plunger 21 into the button 12, an annular capture bump 73 is provided on one or both fingers 13 in the inner passageway of the button 12 (FIG. 5). As the plunger 21 is inserted for the first time, bulge 25 will pass into the passageway and encounter capture bumps 73. Since there is no confining perfboard hole to contend with, fingers 13 can flex sufficiently to permit bulge 25 to snap past capture bumps 73 and into the reset annular depression 71. It should be noted that the inner diameter of the passageway at the capture bumps 73 is greater than that at the thickened portions 69 of fingers 13, so that the operator in inserting plunger 21 will feel a significant difference in insertion resistance as between encountering the capture bumps 73 and the encountering of the cam surface 72 of reset depressions 71, the latter being greater than the former It will also be noted that the entrance side of capture bumps 73 has a greater slope than that of the exit side, and this is to provide the assembler with a feeling of a "snap" fit of the plunger 21 into the reset position as shown in FIGS. 1 and 5.

FIG. 8 is an exploded view of the cooperation between the flexible lip 33 of stanchion 37 and the peripheral lip 27 of plunger head 20.

FIG. 9 similarly depicts the arcuate interference relationship between the arcuate stop member 23 and the peripheral lip 27 of plunger head 20.

FIG. 10 is a perspective view of a 2-hole wall mounted item holder having a single offset hook-like member 11 and a single button 12 below.

Of course, any of the item holders shown and described in the drawing and this description can be mounted in any position on the perfboard, even upside down and sideways, since there is a positive locking of the item holder to the perfboard in the hole or holes into which it is inserted. It is also to be noted that there is positive pressure applied against the rear wall of the perfboard by offset hook-like member 11, the spacing of the tip of which is less than the thickness of the perfboard as described in the aforementioned U.S. Pat. No. 5,407,160.

FIG. 10 also shows the use of the outrigger cavities 17 to provide support for a pair of thin metal rods 91 leading to a display portion 95 for positioning pricing, description, or other information about an item which may be hung from the metal item hanger 5 provided below. Obviously, more than three holes 17, 19 can be provided, and the number of holes may vary dependent upon the use to which the item holder is put and the thickness of the hanger adapter 15 to accommodate such hole configuration.

FIG. 11 is similar to that of FIG. 10 except that it is shown to have a pair of offset hook-like members 11. A single button 12/plunger 21 combination is located in one of the lower corners of the device, while a dummy pin (not shown), or no pin at all, can be provided at the forth corner of the device. This configuration thus requires the use of three or four holes in the perfboard and would typically be used for holding heavier items.

FIG. 11*a* is a rear view of the invention according to FIG. 9 showing a split dummy pin 12*a* and a standard, as described, button fastener 12. FIG. 11*b* is a partial side view depicting what is meant by the split dummy pin 12*a*.

Figure 12B:
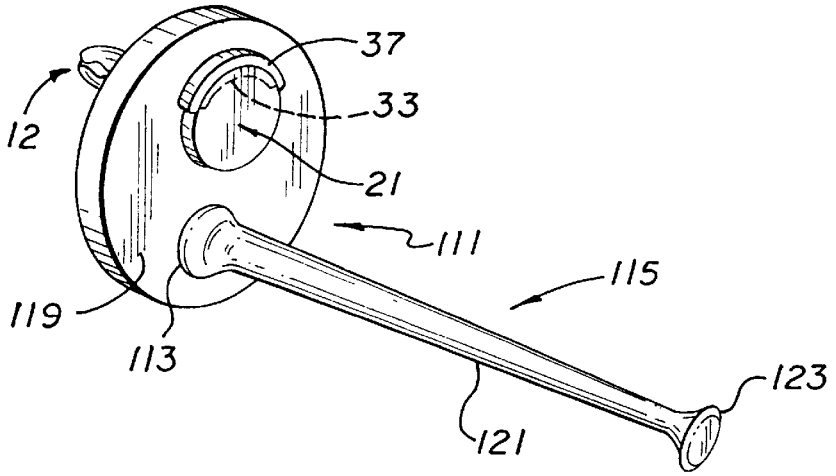

FIGS. 12*a* and 12*b* are single-hole embodiments of the invention wherein a single button 12 extends from the rear of base portions 109 and 119, respectively, and a plunger 21 is insertable from the front. In both FIGS. 12*a* and 12*b*, an arc-shaped flexible stop member 37 cooperates with the peripheral lip 27 of the plunger 21 in the manner hereinbefore described. In FIG. 12*a*, the item holder 101 includes an item hanger 105 and a base 109. The item hanger 105 has a shaft 110 leading to a blunted distal end 107 and a proximal end 108 which is flared to a base 103 formed integrally with base portion 109. The underside of the flared end 108 has an access for the insertion of one's thumb or finger to operate the plunger 21 as hereinbefore described.

In FIG. 12*b*, a similar single hole mounted item holder 111 is shown having an item hanger 115 with a rod-like center portion 121, a blunted distal end 123 and a flared proximal end 113 integral with the base portion 119. The button 12 and plunger 21 operate as described in connection with FIGS. 2 and 4.

Figure 13:
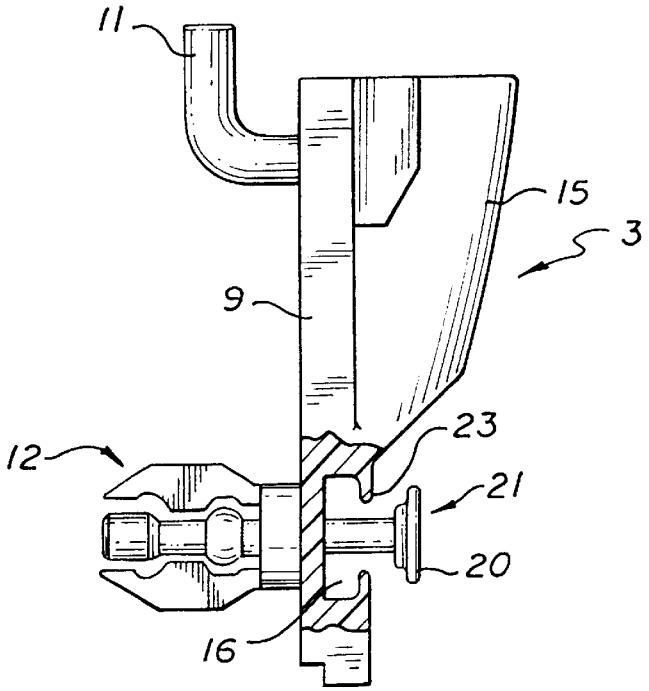
FIG. 13 a partial cross sectional view showing a side view of the embodiment of the invention shown in FIGS. 1–11 except that the flexible stop member for the plunger head has yet a different configuration as seen in cross section.

FIG. 13 shows an item holder similar in construction and operation to that of FIG. 1, except that, once the user pushes plunger 21 into the locked position, the top of the pin head 20 is substantially flush with the outside of the hanger adapter 15 to provide a more aesthetically pleasing surface and profile for the plunger head when the device is in the locked condition. In this embodiment, a space 16 is formed by the inwardly directed flexible stop members 23 which may be fully circular, the space 16 size to receive the fully depressed plunger head 20 in the release mode.

Figure 14:
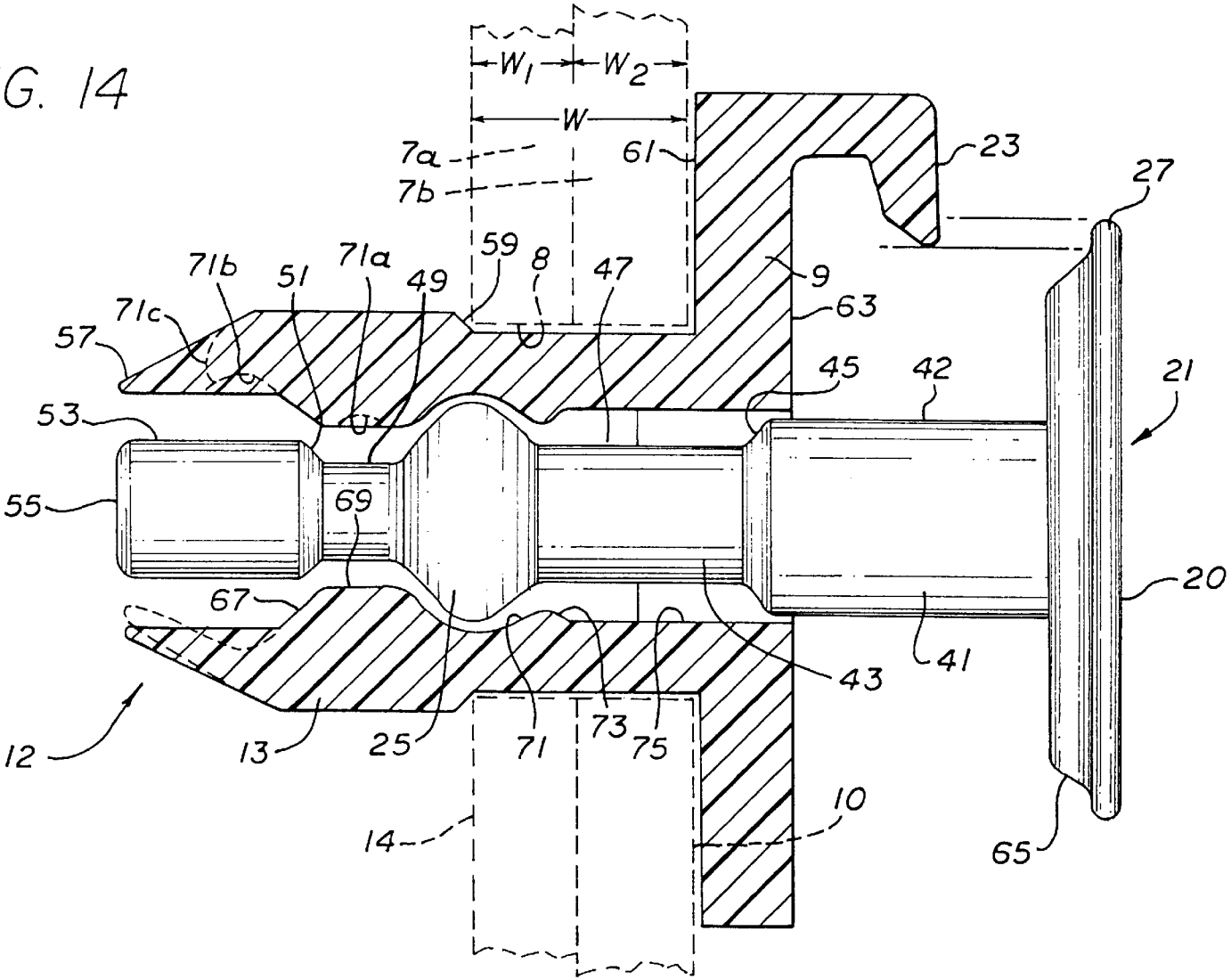
FIG. 14 is a partial cross sectional view showing an alternative form of the present invention for use with joining laminated materials together by locking them with a fastener operating substantially the same as any one of the fasteners shown in FIGS. 1–13, and without an item hanger as heretofore described.

FIG. 14 operates similarly to the previously described embodiments shown in FIGS. 1–9, except that, instead of supporting an item hanger 5, the purpose of the button 12/plunger 21 combination is to lock together two laminates 7*a* and 7*b* having thicknesses $W_1$ and $W_2$, the total thickness being equal to W, the same as the dimension referred to in the description of FIG. 5. In FIG. 14, the flexible stop member 23 is integrally formed with the fastener button 12, and the operation in the reset, locked, and. released positions of plunger 21 is substantially the same as that previously described.

The lock/unlock function of the fasteners described to this point may be referred to as a push/push function. Although likely not cost effective for a pegboard toolholder, the push/push arrangements could alternatively be replaced with a mechanism similar to that of a push/push type ball point pen (not shown).

FIG. 15 is a perspective view of an alternative embodiment of an item holder, or tool holder, which requires no tools for mounting on, or dismounting from, a perfboard. A base portion 121 is provided with an offset hook-like member 123, and, in this embodiment, a cutout 125 in the lower portion of the base portion 121 accommodates a variety of different item hangers 127. FIG. 16 is a cross sectional view of one embodiment of this type of device. The base portion 121 has a cylindrical opening 140 with a lower finger 135 molded integrally therewith. The base portion 121 also has a hinge socket 129 which receives a hinge bar 131 of the item hanger 127. In operation, the hinge bar 131 is first inserted (snapped) into hinge socket 129, and the item hanger 127 is pivoted downwardly until finger 133 passes through opening 140 and bends finger 135 downwardly until finger 133 is fully inserted, and the slanted bottom edge 139 snaps past the slanted receiving ledge in a "snap" fit to lock hanger 127 in place. The dimensioning of edge 139 and ledge 137 is determined by the amount of minimum pull by a tool being removed from the hanger 127, and an eight pound horizontal pull has been found to be sufficient which these cooperating parts can easily accommodate. If preferred, the lower finger 135 may be provided with a concave recess 134 to mate with the complementary bulge on the floor portion of finger 133. A flange 141 may be provided to permit a tool to assist in removing the item holder from the perforated wall, if desired.

FIG. 17 shows a similar arrangement as that shown in FIG. 16, except that the base portion 143 comprises an upper finger 145, and the hanger 147 comprises a lower finger 149, a ledge 151 being provided for the same purpose as that shown at 141 in FIG. 16.

FIG. 18 shows the base portion 143 without hanger 147 of FIG. 17. In both FIG. 16 and FIG. 17 embodiments, pressure is primarily and advantageously applied against the rear of the perforated wall 7 farthest from the offset hook-like member 123 so that positive pressure is applied against the rear of both holes into which the item holder is inserted.

FIGS. 19–22 show an alternative embodiment of the invention in which the item hanger 171 is rotated to lock the holder body base portion 161 into position on the perfboard. FIG. 19 shows such an arrangement in which a base portion 161 has a circular bore 163 provided therein and a slotted receiver channel 167. Integral with the base portion 161 is a formed finger 165 for insertion through the hole 8 in a perfboard 7. Finger 165 is formed at an angle with respect to base portion 161 so as to be perfectly guided into the hole 8 of perfboard 7 when the item holder is installed.

Viewing FIGS. 20 and 21, it will be noted that a hanger 171 has an integral base portion 173 being oval in shape, and a circular boss 177 is fitted opposite the base of hanger 171. A narrowed neck 179 extends from boss 177 and then expands to a half cylindrical rod 181 having a flat surface 183. A bump 175 is formed of the same molded material as that of the rest of the hanger 171 device.

In operation, the hanger 171 is turned at 90 degrees to its usable position, and in this position, the flat surface 183 of half cylinder 181 faces downwardly. By pushing the half cylinder 181 through opening 163, it pushes against finger 165 to cause it to move downwardly and latch to the rear of perfboard 7 to some degree by the action of the shoulder 184 with the rear of the perfboard 7. The slotted receiver channel 167 is also oval shaped horizontally, so that the hanger device can be inserted fully until base portion 173 meets with the bottom of the slotted receiver channel 167 as seen in FIG. 20.

FIG. 20*a* is a view of the end only of the arrangement of half cylinder 181 and finger 165 in the condition shown in FIG. 20. By rotating the hanger 171 counter clockwise (clockwise in FIG. 20*a*), the long dimension of the base portion 173 will engage the shorter dimension walls of the slotted receiver channel 167 which, in the top slot thereof, has a depression 185 to receive the bump 175 on base portion 173.

This rotation of hanger 171 will cause the half cylinder 181 to rotate until it is in the position shown in FIG. 22, where the radius of the half cylinder 181 in the downwardly oriented direction changes from zero to one-half the cylinder diameter, thus wedging the end of finger 165 downwardly as shown in FIG. 22 and locking against the rear of the perfboard 7. For a more secure latched condition, one edge of half cylinder 181 may have a flat side 180 which conforms to the flat top surface 182 of the finger 165 in a "snap" action. The removal procedure includes rotating the hanger 171 in the opposite direction until in the original horizontal position and then removing the hanger 171 by pulling it through the unimpeded opening in the slotted receiver channel 167. The finger 165 relaxes, and the entire item holder can then be removed from the perfboard 7.

Figure 23:
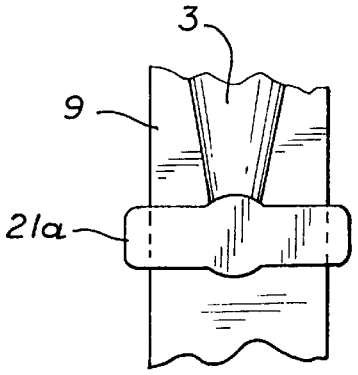
FIG. 23 is a partial front view of the item hanger according to FIG. 3 with the plunger having extensions lateral of the base of the item holder for easy grasping and removal of the plunger by the user.
Figure 23A:
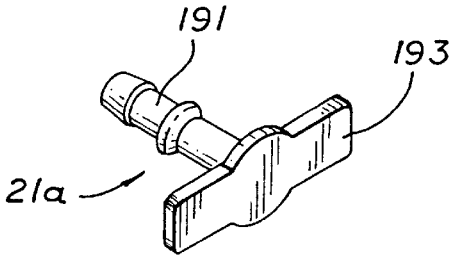
FIG. 23*a* is a perspective view of a plunger suitable for implementing the feature of the invention shown in FIG. 23.
Figure 23B:
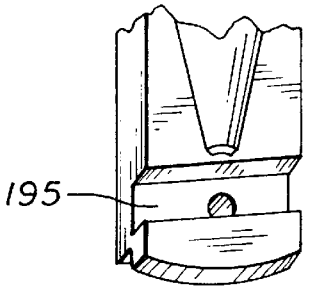
FIG. 23*b* is a partial perspective view of the base member of FIG. 23 without the plunger in place.

FIG. 23 shows an alternative configuration of the relationship between the plunger 21*a* and the body portion 9 of the item holder having reference to FIGS. 1 and 3. In FIGS. 23–23*b*, it will be observed that a slot 195 is provided extending to bothedges of the base portion 9, and the plunger 21*a* has a head 193 and a pin 191 which operate functionally the same as that earlier described, with the exception that the head 193 of plunger 21*a* extends laterally to overlap the sides of base portion 9 as seen in FIG. 23. The user then may simply pull the head portion of plunger 21*a* backwards to release the locked condition of the device. This is yet another configuration which requires no tools for either mounting or dismounting an item holder. Of course, the shape of pin 21*a* and the finger or fingers of a button fastener into which it is inserted may provide for a retention of the pin 21*a* in a released or storage position according to any of the examples presented herein so as not to lose the pin 21*a* inadvertently.

Figure 24:
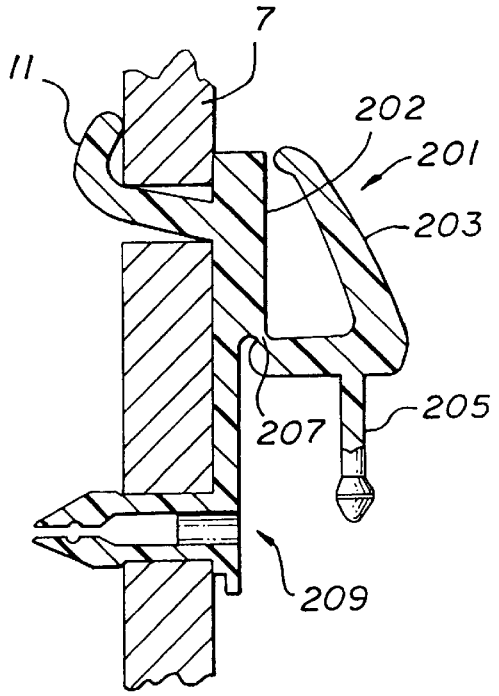
FIG. 24 shows a cross sectional view of a further embodiment of the invention in which the item hanger formed integrally with the base member and swingable into locking position.
Figure 25:
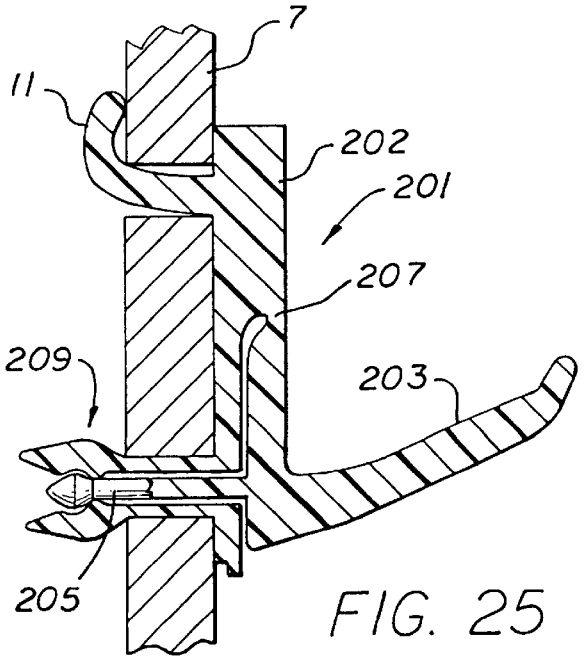
FIG. 25 shows a cross sectional view of the embodiment of the invention according to FIG. 24 with the item hanger moved to the locked position.

FIGS. 24 and 25 show yet a further embodiment of the invention in which the base portion 202 is formed integrally with the hanger portion 203, thereby forming a monolithic item hanger 201. The base and hanger portions 202, 203 are joined at a thinned area 207 which may be referred to as a "living hinge". The hanger 203 has a pin 205, while the integral base portion 202 has a button fastener 209. FIG. 24 represents the molded configuration of the device.

In operation, the offset hook-like member 11 is inserted in the top hole, and the fastener 209 is swung down to be inserted in the bottom hole. The hanger 203 is then swung down by the action of the living hinge 207 until pin 205 enters button 209 and pushes the fingers of button 209 apart to lock the device to the wall. To remove the device, it is only necessary to pull back on the hanger portion 203 until the bulge of the pin is released, after which the fingers will collapse making the device removable from the wall.

FIGS. 26–28 illustrate another embodiment which is similar to that described in connection with FIGS. 24 and 25 except that, instead of a "living hinge" thinned portion 207 and being a monolithic molded device, the item holder of FIGS. 26–28 is made in two different pieces, a base portion 217 and a hanger 213 defining the alternative item hanger 211. In operation, the offset hook-like member 11 is inserted in the top hole of the perfboard, and the device is swung downwardly until the fastener button 223 is inserted into the bottom hole. As with the invention described in connection with FIGS. 16 and 17, the end of arm 219 is inserted into a complementary slot provided in base portion 217 to form a hinge 221, the two parts snapping together due to the size of the end of arm 219 and the diameter of the slot in the body portion 217. The hanger 213 is then rotated downwardly until pin 215 enters the fastener button 223 to expand the fingers thereof and lock the hanger into position. The latching of the hanger 213 into position is enhanced by the sharp edge 225 having an interference fit with the ledge 227 as hereinbefore described. The hinge "snap" feature is best illustrated in FIG. 27 where the diameter of the rounded hinge end 233 is approximately the same diameter as the opening 231 in the base portion 217, but the opening 231 has a circumference of greater than 180 degrees so that the two pieces snap together due to the resiliency of the plastic material from which each is made.

FIGS. 29–31 show yet a further embodiment of the invention in which the base portion 240 and pin portion 247 are formed monolithically. A thinned portion 245 constituting a "living hinge" permits the pin portion 247 to be pivoted upwardly until pin 247 enters fastener button 242 and spreads fingers 249 apart to lock the device to the perfboard 7. A tool hanger (not shown) is located at the top of the base portion 240.

FIG. 32 is similar in construction, except that the lower portion 267 of the base portion 260 is thinned, as is the part of the base portion supporting pin 265. In this way, the fully locked condition of the device as shown in FIG. 32 will have the total thickness of the lower base portion and pin support portion equal to the thickness of the upper base portion for an aesthetically pleasing look and feel, as well as providing less interference with an object which might bump the end 251 of the device shown in FIG. 31. For removal purposes, the ledge 251 of the device shown in FIG. 31 and the ledge 275 shown in FIG. 32 can be manipulated by one's finger. A space 273 is provided to leave ample room for one to pull back the tab 275 for removal.

FIG. 33 is a perspective view similar to that shown in FIG. 11, except that a pair of larger main bores 19 and U-shaped channels 40 are provided to accommodate item hangers having configurations more complex than a single rod. FIG. 34 shows a simple example of that, wherein a U-shaped bent steel rod has two free ends to fit into the bores 19 and will snap into position in both channels 40 by the action of the barbs 39 as hereinbefore described. The embodiment of FIG. 2 is very useful for supporting wire frameworks for holding such heavy tools such as routers, planes, sanders, and any other item weighing up to 50 pounds or more.

It will be appreciated that most of the embodiments of the described invention can accommodate multiple hanger portions. An example would be a modification of the item holder shown in FIG. 34 which, instead of a single continuous looped bent rod, can support two separate parallel, diverging, or emerging rods for holding a hammer or mallet.

It should be understood that placing the fastener button or button portion at the top or bottom of an item holder body is a matter of choice, as is providing the item holder with one or more buttons or button portions, or with one or more offset rear hook-like members, or with one or more item holding portions. It should also be understood that a simplified basic embodiment of the invention is an item holder having a base member, a separate or integral fastener button, item holding portion, without an extension portion. The latter embodiment would be useful for holding tools or other items that can be supported on a single straight symmetrical hanger, so that occasional rotation of the item holder about the hole in which the fastener button is installed will not change the orientation of the hanger. All such alternatives and combinations thereof are deemed to be within the scope of the invention described herein.

Another variation from the described embodiment is an integrated body, button fastener, and pin design, where all three items are molded within the same mold cavity, and with the pin connected to the base or body portions by a very thin connecting tether strap. This will permit the pin to move more freely than in the embodiments described in connection with FIGS. 24, 25, and 29–32 in which the pin is restricted to move in a single plane. In particular, it will permit the pin to be molded in a preferred orientation relative to the rest of the item holder and yet be insertable in the button fastener by twisting the strap 90 degrees.

FIG. 35 shows an alternative embodiment of the invention in the form of an item holder 300 which comprises a sliding body camming member 303, a base portion 308 having fastener fingers 301 and 302, and a plunger 311 having a ball end 313. The sliding body 303 fits onto the body portion 308 by any known mechanical arrangement, two dovetail arrangements being shown in FIGS. 36 and 37 by way of example.

In the position shown in FIG. 35, the sliding body 303 is in the unlatched position where the stop shoulder 305 is well above the top 307 of the base portion 308. An offset member 11 is shown passed through the top hole in the perfboard 7, and a fastener 304 is shown having been passed through the bottom hole of the perfboard 7, the fastener 304 having fingers 301 and 302 in a relaxed position. A plunger 311 has its ball end 313 captured in the lower end of a cam slot 309 formed in the sliding body 303. A detent 319 (or pair of detents 319) in the sliding body 303 mates with a release bump 317 (or pair of release bumps 317) to keep the sliding body 303 in a predetermined unlatched position relative to base portion 308.

In the position of the sliding body 303 as shown in FIG. 35, the entire item holder 300 may be easily removed by lifting up on the item hanger 5, since the fingers 301 and 302 of the fastener 304 are in the relaxed condition. However, as the sliding body 303 slides downwardly, the ball end 313 of the plunger 311 is cammed by the walls of cam slot 309 to push the plunger 311 into engagement with fingers 301, 302 and spread them apart laterally of the axis of the fastener 304. When the sliding body 303 is at its lowest position, a stop shoulder 305 will butt against top 307 of the base portion 308, and latch bump 315 (or pair of bumps 315) will be captured in the release bump (or bumps) 317 of the body 303. The action of the release bump 317/latch bump 315 and stop shoulder 305/top 307 combination provides a stable lock position for the sliding body 303 on the base portion 308.

For heavy duty functions, the standard dovetail arrangement shown in FIG. 36 may not be adequate, since there is a tendency to separate the body 303 from the base portion 308 by the pulling force caused by weight applied to item hanger 5. A more secure sliding dovetail arrangement is shown in FIG. 37 in which the rail 308' is captured in the slot 306 of the sliding body 303' an d works against cooperating flat surfaces as opposed to sloping surfaces as in the arrangement of FIG. 36.

FIGS. 38–40 show an alternative embodiment of the invention in which a crank 355 having a crank handle 357 is rotatably mounted in body 351. The crank 355 has a shank 369 and a half cylinder mover 363 passing through an opening in the body 351. A shoulder 365 on the crank shank 369 butts against a collar 367 of the body 351 to prevent the crank 355 from being inadvertently removed from the body 351. A relief portion 354 of the mover 363 is provided to allow the end of finger 353 to collapse into the relief region 354 as the finger 353 and mover 363 pass through the hole in the perfboard 7.

An interference bump 359 may be provided on the lower end of body 351, the crank handle 357 having to pass over the bump 359 into a latched position 361 as shown in FIG. 40. As the crank handle 357 is rotated clockwise as shown in FIG. 40, the half cylinder mover 363 rotates to cam the finger 353 downwardly and latch the body 351 to the perfboard 7.

FIG. 39 shows the end view of the mover 363 and finger 353, the camming action of the mover 363 against finger 353 being readily evident to a person of ordinary skill in the art of mechanics, so that no further explanation would appear to be warranted.

Instead of, or in addition to, using a latch bump 359, the left side of mover 363 as seen in FIG. 39 can be flattened so as to provide a stable parallel contact area 364 that engages the top of finger 353.

Figure 41:
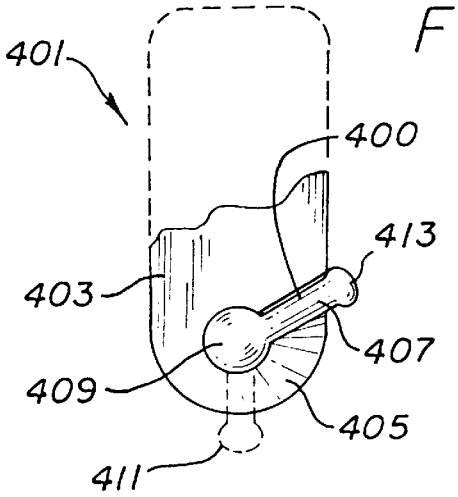
FIG. 41 shows a further embodiment of the invention in which a crank plunger is moved in and out of a fastener on the body portion by the camming or ramping action between a cam surface on the body portion and the arm of the crank.
Figure 42:
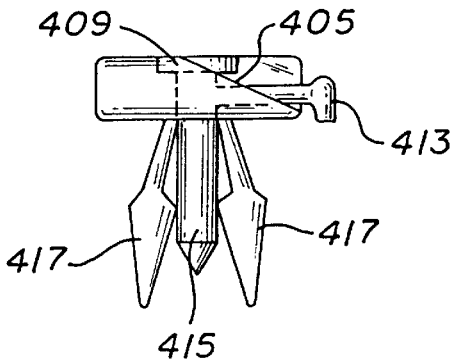
FIG. 42 is a bottom view of the arrangement shown in FIG. 41 with the plunger fully depressed and the fastener fingers spread apart.
Figure 43:
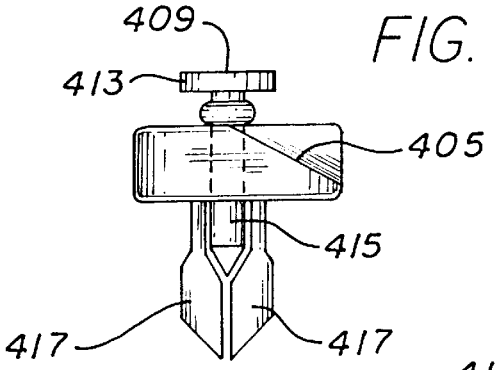
FIG. 43 is a bottom view of the arrangement shown in FIG. 41 with the arm of the crank ramped fully upwardly to release the plunger from the fastener.

FIG. 41 shows a further embodiment of the invention in which the item holder 401 has a body 403 with a circular ramp 405 acting as a cam surface for camming an arm 407 of a crank 400 upwardly as the crank arm 407 rotates counterclockwise as viewed in FIG. 41. FIGS. 42 and 43 will assist in understanding the operation of the item holder 401. When the base portion 403 is mounted to a perfboard wall, the crank arm 407 may be in any position at or between the positions shown in solid and dashed lines 411 in FIG. 41, for so long as the plunger 415 is out of contact with the fingers 417. One possible position for the crank arm 407 is shown in FIG. 43 where the end 413 of the crank arm 407 is seen to be in a position the same as that shown in dashed lines 411 of FIG. 41. It can be seen that the plunger 415 may not be pushed inwardly in this condition. Accordingly, the user may either slide the arm 407 down the ramped or cammed surface 405 of the base portion 403 or simply rotate the arm 407 to the position shown in solid lines of FIG. 41 and then push the top 409 of the crank 400 which causes the plunger 415 to move into contact and spread apart fingers 417 as best seen in FIG. 42.

After latching to the perfboard, the end or handle 413 of the crank arm 407 may be rotated counterclockwise as seen in FIG. 41, the arm 407 ramping against ramp 405 pulling the plunger 415 out of engagement with fingers 417 and releasing the fastener for easy removal of the item holder from the perfboard.

Figure 43A:
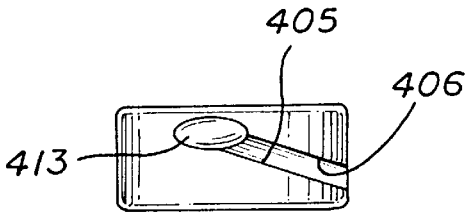
FIG. 43*a* shows a bottom view of a modification of the arrangement shown in FIG. 41 in which a dual cam surface design serves to cam the plunger inwardly and outwardly as the crank is rotated, the arm of the crank being captured between the two cam surfaces.
Figure 44:
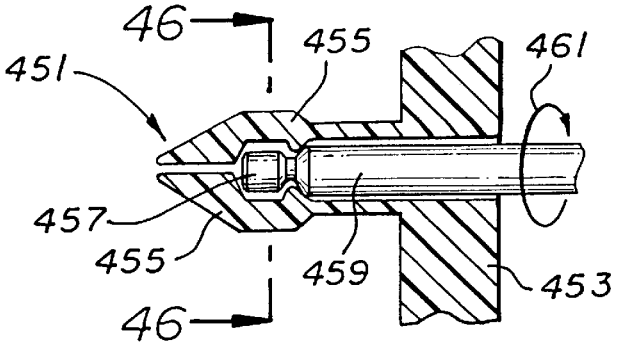
FIG. 44 shows a partial cross section of an alternative embodiment of the fastener and crank in which the shaft of the crank does not move axially, but rather rotates to cam the fingers of the fastener apart or not, dependent upon the rotational position of the crank shaft.

FIG. 43*a* shows an improvement of the configurations of FIGS. 42 and 43 by the provision of a pair of cam surfaces 405 and 406, essentially creating a cam slot between them, the arm 407 of crank 400 being cammed in both directions of rotation of the crank arm 407 to force the plunger 415 into and out of engagement with fingers 417 as the crank arm 407 is moved counterclockwise and clockwise, respectively.

FIGS. 44–48 (FIGS. 46–48 being enlarged views) show yet a further embodiment of the invention in which the crank 463 is restricted against axial movement within a base portion 469 by a collar 467, near the handle end of the crank 463, and a shoulder 475, near the free end of the crank 463, the collar 467 and shoulder 475 being stopped from axial movement by corresponding shoulders 470 and 477 of base portion 469.

The cam 457 at the end of crank shaft 459 is shaped, in cross section, as best seen in FIG. 47. It has a pair of flat surfaces 483 on opposite sides of the cam 457 and circumferentially intermediate and opposing rounded surfaces 480 smoothly flowing into the flat surfaces 483. Likewise, the walls of fingers 455 have flat surfaces 481 at the axial position adjacent cam 457.

In assembly, the crank 463 is forced into base portion 469 in the FIGS. 45 and 45*a* position (fingers 455 relaxed), and, due to the wedging action of the conical shaped nose 457*a* of cam 457, the lower end of collar 460 is temporarily expanded until the shoulder 475 passes by shoulder 477. Then, the collar 460 snaps back into its relaxed position, and the crank 463 is secured axially. The collar 460 has a pair of oppositely positioned axial slots 460*a*, i.e., radially widened segments of otherwise cylindrical collar 460, to permit the widest portion of cam 457 to pass through collar 460. Collar 460 has a short narrowed inner surface diameter adjacent its bottom as viewed in FIG. 45*a*, thereby providing 360° of shoulder 477 against which the shoulder 475 of cam 457 engages in a sliding relationship as crank shaft 459 rotates. The crank 463 is inserted with the operating button 465 in a position similar to that shown in solid lines in FIG. 41, and with the cam 457 shown in the position of FIGS. 45, 45*a*, 46 and 47.

In operation, the item holder is placed on the perfboard wall 7 with the fingers 455 in their collapsed position as shown in FIG. 45. The crank 463 is then rotated clockwise as viewed from the top of FIGS. 45 and 45*a* by moving button 465 (similar to the action of crank 400 shown in FIG. 41), and cam 457 then acts against the inner surfaces of fingers 455 to cam them radially outwardly to the position shown in FIG. 48, thereby locking the fingers 455 against, and applying positive pressure against, the rear of the wall 7 and securing the item holder into position on the wall 7 (the fingers 455 then assuming a position similar to that shown in FIG. 42).

Rounded surfaces 480 on cam 457 serve to cam the fingers 455 outwardly in a smooth and continuous action until the flat surfaces 483 of the cam 457 engage the flat surfaces 481 of the fingers 455, the cooperating flat surfaces 483, 481 acting to stabilize the crank shaft 459 in the latched position. For additional security, an interference or latch bump similar to that shown and described in connection with FIG. 40 may also be employed in the embodiments of FIGS. 41–48. Alternatively, or additionally, cooperating bumps and pits 490, 492 may be provided on the cam 457 and fingers 455, respectively, or reversely, to assist in retaining the crank 463 in the latched condition.

FIG. 49 shows an item holder 501 which is functionally similar to that shown in FIG. 1 except that a groove 513 and slot 511 are provided on body 503. The groove 513 and slot 511 are designed and shaped to receive a mounting portion of a wire frame 515 shown in FIG. 50. When inserted onto the item holder 501, wire frame 515 has a horizontal top portion 517 which fits down into slot 511. Wire frame 515 also has a configured segment 519 to fit into groove 513 of the body 503. Vertical sections 521 of wire frame 515, as well as horizontal sections 523, press against the perfboard 7 (not shown) when the wire frame 515 is installed on body 503, and the combination item holder is mounted to a perfboard wall. The contact with the wall by segments 521, 523 provide a cantilever action for strong support of arms 525 extending away from the wall upon which the item holder is mounted.

It will be understood that various combinations of wire forms and grooves and slots other than those depicted in FIGS. 49 and 50 are possible and practical. For example, instead of a deep slot 511 shown in FIG. 49, groove 513 may continue along top of the base portion in the same manner as the path of slot 511 without the deep penetration into body 503 as depicted. Furthermore, groove 513 may simply be a vertical groove along the side of body 503 and a connecting groove along the top of body 503, all of such grooves (not shown) being positioned adjacent the wall surface upon which the item holder is mounted. The same cantilever action would advantageously result, and that is the important characteristic of this combination of wire frame and body arrangements. Additionally, a wire frame may be formed to include a number of mounting portions that are received by appropriately configured grooves and/or slots of a number of item holders, the frame thus being supported by the multiple item holders. FIGS. 51–55 show another embodiment of the invention in the form of an item holder 601 which comprises a dual plunger arrangement that permits a user to lock and release the item holder 601 to and from a perforated wall 604 by alternately actuating a lock mechanism 603 and a release mechanism 607, respectively. The embodiment shown in FIGS. 51–55 represents a variation of the push/push function described previously in connection with FIGS. 1–9. The lock mechanism 603 includes a lock plunger 610 having a lock button 606 and a button fastener 628. The release mechanism 607 includes a release plunger 612 which includes a release button 608 and one or more thin compression wings 625 provided near the end of the release plunger 612 opposite the release button 608.

The item holder 601 is provided to the user in the condition shown in FIG. 51. A user installs the item holder body 601 on a perforated wall in the manner described hereinabove for other embodiments. The user then actuates the lock mechanism 603 by pressing the lock button 606 which forces the lock plunger 610 into engagement with the fingers 627, thereby spreading the fingers (to the position shown in phantom lines) and locking the item holder 601 to the perforated wall 604 in a manner described previously hereinabove. Pressing the lock button 606 in an inward direction toward the perforated wall 604 also results in concomitant movement of the release plunger 612 in an outward direction opposite to that of the lock plunger 610. To remove a fully installed and locked item holder, a user actuates the release mechanism 607, shown in an inactivated orientation in phantom lines, by pressing the release button 608 inwardly toward the perforated wall 604 which, in turn, forces the lock plunger 610 out of engagement with the fingers 627, allowing the fingers 627 to collapse sufficiently to remove the button fastener 628 from the wall 604.

The lock plunger 610 includes at least one retention tab 623 which extends radially outward from the lock plunger 610 near the end of the lock plunger 610 opposite the lock button 606. The retention tab 623 engages a shoulder 624 at an end of the axial passageway 618 to inhibit the lock plunger 610 from moving backwards (outwardly) beyond the shoulder 624 and into the axial passageway 618 during actuation of the release mechanism 607. The retention tab 623 is relatively rigid, and as the plunger arrangement is installed in the body base 602, retention tab 623 forces the relatively softer inwardly directed cylinder tab 626 defined by two spaced slits 626' (FIGS. 53 and 54) to move radially outwardly. After retention tab 623 passes by cylinder tab 626, the latter snaps back to its original position to block passage of retention tab 623 in the reverse direction.

FIG. 54 shows a view of fingers 627 and a portion of the cylindrical wall 630 that defines a corresponding portion of the axial passageway 618 of the lock mechanism 603. The pair of slits 626' extend from the end of the cylindrical wall 630 and provide for a moderate degree of cylindrical wall flexing so that the lock plunger 610 and retention tab 623 may pass through the axial passageway 618 during initial installation of the lock plunger 610 into its operating configuration. Reference is made to FIG. 5 which illustrates another plunger capturing scheme.

The compression wings 625 provided near the end of the release plunger 612 opposite the release button 608 comprise thin, concentric rings or other flexible protrusions that extend radially outwardly from the release plunger 612 and have a diameter or radial dimension that is slightly larger that the diameter of the release plunger 612 and slightly larger than the diameter of the axial passageway 614. The compression wings 625 are preferably disposed in a recessed end portion 629 of the release plunger 612, as is best seen in FIG. 55. The compression fit between the compression wings 625 and the axial passageway 614 provides frictional resistance between the release plunger 612 and the axial passageway 614 within which the release plunger 612 moves, stabilizing the release plunger 612 at all axial positions. This frictional resistance assists in maintaining the item holder 601 in an unlocked configuration while the item holder 601 remains installed on the perforated wall 604. This frictional resistance also assists in maintaining the item holder 601 in a locked configuration as well.

The reciprocating action of the lock mechanism 603 and the release mechanism 607 is provided in part by employment of a lever member 611 hingedly coupled to the lock plunger 610 and the release plunger 612. The lever member 611 includes generally thinned connecting portions 619 and 621 which connect the lever member 611 to the lock and release plungers 610 and 612, respectively. The thinned connecting portions 619 and 621 permit a moderate degree of flexing of the lever member ends at the lock and release plunger connection locations as the lock and release plungers 610 and 612 move in a "see-saw" manner with respect to one another. The thinned connecting portions 619 and 621 may thus be considered a type of "living hinge" which permits the assembly defined by the lock and release plungers 610, 612 and lever member 611 to be fabricated as a single, integral part.

The lever member 611 pivots about a fulcrum 613 when moving between a locked orientation, defined as the lock plunger 610 fully engaging the fingers 628, and an unlocked orientation, defined as the lock plunger 610 withdrawn and fingers 627 being in a collapsed configuration. It is to be noted that the fulcrum 613 is shown not as a raised point as in a conventional scheme, but is rather incorporated as part of a fulcrum ledge 617, since the lever member 611 need not pivot beyond the fulcrum ledge 617 to accomplish the release function as described in accordance with the embodiment shown in FIG. 51.

FIG. 52 shows a partial front perspective view of the embodiment illustrated in FIG. 51. FIG. 52 provides a view of the control region of the item holder 601 which is utilized by a user when actuating the unique dual plunger locking and release feature. A control pad 631 may protrude from the base 602 of the item holder 601 and include a lock button recess 605 and a release button recess 609 for respectively accommodating the lock button 606 and the release button 608. A channel recess 616 extends between the lock button recess 605 and the release button recess 609 to accommodate the lever member 611 when the lock and release plunger and lever arm assembly 610, 612, 611 is installed into the base 602 of the item holder 601, preferably being retained therein by use of a "snap-fit" capture and retention scheme using any of a number of known mechanisms that perform such a function.

FIGS. 56–60 depict yet another embodiment of the "no tools required" item holder in accordance with the invention. This embodiment is similar in concept to that of FIGS. 44–50. In the embodiment of FIGS. 56–60, however, there is provided a groove 513*a* on both sides of the item holder body 503*a* and, optionally, a groove 513*b* along the top, as best seen in the side view of FIG. 56.

The cross sectional view of FIG. 57 shows the top groove 513*b* open at the top and having a circumference of greater than 180°. This forms a keeper ledge or projection 503*d* which is effective to temporarily bend the top rear wall 503*c* of body 503*a* rearwardly as a portion of a wire frame (not shown, but functionally the same as that shown in FIG. 50) is pressed into groove 503*b* in a "snap fit" fashion. After seating the wire frame portion into groove 503*b*, keeper ledge 503*d* holds the wire frame firmly in place.

The fingers 455*a* and 455*b* are shaped to permit the tip of the bottom finger 455*b* to terminate substantially at the axis of the cylinder 630*a*, allowing more accurate and unobstructed entry into the hole in the perforated board into which fingers 455*a* and 455*b* fit. Top finger 455*a* is shortened so as not to touch the tip of bottom finger 455*b* when the fingers are pressed together during entry into or exiting of the hole.

FIG. 58 is a front view of the just-described embodiment showing an alternate shape for the crank handle 463*a* which is shown to be crescent shaped with a knurled operating surface 43*b*. Additionally, and opposite to the embodiment of FIGS. 44–49, crank handle 463*a* has a starting (unlocked) position (shown in phantom) at nine o'clock against a body stop 503*e* and a locked position (shown in solid lines) at six o'clock against a second body stop 503*f*.

FIG. 59 shows the crank 463*a* for the embodiment of FIGS. 56–58 in the locked position, the cam 457*a* effective to spread fingers 455*a* and 455*b* to press against the rear of the perforated wall. FIG. 59*a* is an end view of the cam 457*a* in the locked position.

FIG. 60 shows the crank 463*a* in the released position, the cam 457*a* being spaced between the fingers 455*a* and 455*b*, permitting the fingers 455*a* and 455*b* to collapse sufficiently to pull them out of the hole in the perforated wall without obstruction. FIG. 60 is an end view of the cam 457*a* in the released or unlocked position.

The retention tabs 623*a*, on both sides of shaft 459*a* of crank 463*a* function identically to those described in connection with FIGS. 51, 53, and 54, the end of cylinder 630*a* being of substantially the same construction as shown in FIGS. 53 and 54.

Another feature of the FIGS. 56–60 embodiment over that of FIGS. 44–50 is that with the latter, the wire frame sides 521 and 523 rested against the perforated wall, while with the former (FIGS. 56–60), the sides, and optionally the top grooves, are fully contained within the body 503*a*, so that the sides, and/or top, of the wire frame does not rest on the perforated wall, giving more precision and stability of the inserted wire frame.

If desired, only a top groove 513*b* is provided, with the side grooves 513*a* being optional. Also, as shown in FIG. 57, both the main hanger rod support hole 19 and the slot arrangement 513*a*, 513*b* can be used simultaneously without the hanger rod 5 and wire frame interfering with one another.

As with the other embodiments hereinbefore described, a wire frame (not shown) may be formed to include a number of mounting portions that are received by appropriately configured side and/or top grooves and/or hanger rod holes of a number of item holders, the frame thus being supported by the multiple item holders.

The body 503*a* may have any or all of the features shown in FIGS. 10, 11, 11*a*, and 11*b* in addition to the groove 513*a*, 513*b* feature.

All parts of the above-described item holders, including those having separate base and body portions, may be fabricated using injection molding techniques and any reasonably rigid material, such as nylon, polypropylene, polyethylene, ABS, and PVC, either natural or filled, for so long as the finger or fingers remain pliable enough to be moved radially outwardly as desired. On the other hand, the separate pin members can be made of more solid material, such as a glass filled polymer, aluminum, brass, or other hard material that does not yield to torsion or bending stress.

Obviously, many modifications and variations of the present invention will be apparent to those skilled in the art. For example, any embodiment using two fingers may work sufficiently well using one finger and vice versa. In this connection, a single-hole embodiment will work especially well with perforated walls having square holes. In such a case, the collar portion of the aforedescribed fasteners that passes through the hole is formed with a square or rectangular cross section rather than with a circular cross section as shown and described herein. Clearly, any geometric form for the cross section of the collar portion may be adopted, dependent upon the nature and compatibility of the holes in the perforated wall.

Any camming action may act on only one pair of surfaces or on opposing pairs of surfaces, as anyone of ordinary skill in the art will appreciate after learning of the concepts and functions described and shown herein. The term "insertion direction" can be the opposite direction from that illustrated and described, with obvious modification of the various parts to implement such alteration of direction.

It is therefore intended that the scope of the invention be solely limited by the claims appended hereto.

What is claimed is:

1. An item holder adapted to be mounted to the front surface of a perforated wall having front and rear surfaces and having spaced holes therein, said item holder comprising:

a base having front and rear surfaces and including first and second projecting members protecting from said base rear surface for fitting in two holes from the front surface of a perforated wall to which said item holder is to be mounted, one of said first and second projecting members having a portion adapted to be positioned against the rear surface laterally of the hole into which it is to be inserted; and a camming member having at least a portion extending along, and rotatable about, an axis oriented in a front-to-rear direction relative to said base, said camming member selectively engaging said one projecting member, whereby rotation of said rotatable camming member effects movement of said one projecting member portion adapted to be positioned against, and apply positive pressure against, the rear surface radially of the hole of the perforated wall to which said item holder is to be mounted.

2. A method for mounting an item holder to the front surface of a perforated wall having front and rear surfaces and having spaced holes therein, the item holder having a base with front and rear surfaces and with a rear hook-like member extending therefrom, a rear projection having a displaceable portion, and a camming member having at least a portion extending along, and rotatable about, an axis oriented in a front-to-rear direction relative to said base, said method comprising:

placing the item holder on the wall by inserting the hook-like member into a first hole of a perforated wall to which said item holder is to be mounted;

inserting the rear projection into a second hole of the perforated wall to which said item holder is to be mounted; and rotating the camming member about said axis to effect displacement of the displaceable portion of the rear projection to move it laterally of the second hole.

3. A method for mounting an item holder to the front surface of a perforated wall having front and rear surfaces and having spaced holes therein, the item holder having a base with a rear hook-like member extending therefrom, a rear projection having a displaceable portion, and a rotatable camming member comprising a shaft, said method comprising:

placing the item holder on the wall by inserting the hook-like member into a first hole;

inserting the projection into a second hole;

selectively rotating the shaft to effect displacement of the displaceable portion of the rear projection to move it laterally of the second hole; and selectively rotating the shaft to release displacement of the displaceable portion for removal of the projection from the second hole.

4. An item holder in combination with a perfboard having regularly spaced holes, said item holder comprising:

a base having a front side and a rear side;

an item holding component on said front side;

a fastener projecting from said base rear side, said fastener insertable into and removable from one of said holes in said perfboard, said fastener having spaced fingers each including a proximal portion closest to said base and a distal displaceable end portion adapted to be movable laterally relative to said proximal portion, said fastener having a passageway extending axially of said projecting fastener; and a shaft rotatable in said passageway, said shaft comprising an end portion for engaging and moving said displaceable end portions laterally relative to said proximal portions upon rotation of said shaft.

5. The combination as claimed in claim 4, wherein:

rotation of said shaft in one rotational direction effects increased contact pressure with, and increased displacement of, said displaceable end portion relative to said proximal portion, to lock said fastener and said base onto said perforated wall; and rotation of said shaft in an opposite rotational direction effects decreased contact pressure with, and permits decreased displacement of, said displaceable end portion relative to said proximal portion, to permit removal of said fastener from said hole.

6. An item holder in combination with a perfboard having regularly spaced holes, said item holder comprising:

a base having a front side and a rear side;

an item holding component on said front side;

a fastener projecting from said base rear side, said fastener adapted to be inserted into and removed from one of said holes in said perfboard, said fastener having a portion thereof adapted to extend beyond the hole of the perfboard, said projection portion being displaceable laterally of the hole to resist movement of said fastener and said base in a rear-to-front direction, said fastener having a passageway extending axially of said projecting fastener; and a shaft rotatable in said passageway for engaging and moving said displaceable projection portion laterally upon rotation of said shaft.

7. The combination as claimed in claim 6, wherein:

rotation of said shaft in one rotational direction effects increased contact pressure with, and increased displacement of, said displaceable projection portion relative to the hole into which said fastener is inserted, to lock said fastener and said base onto said perfboard; and rotation of said shaft in an opposite rotational direction effects decreased contact pressure with, and permits decreased displacement of, said displaceable projection portion relative to the hole from which said fastener is to be removed, to permit removal of said fastener from the hole.

* * * * *